US009832571B2

(12) United States Patent
Russell

(10) Patent No.: US 9,832,571 B2
(45) Date of Patent: Nov. 28, 2017

(54) ACOUSTIC TRANSDUCER SYSTEMS WITH TILT CONTROL

(71) Applicant: Audera Acoustics Inc., Schomberg (CA)

(72) Inventor: David Russell, Toronto (CA)

(73) Assignee: AUDERA ACOUSTICS INC., Schomberg (CA)

( * ) Notice: Subject to any disclaimer, the term of this patent is extended or adjusted under 35 U.S.C. 154(b) by 0 days.

(21) Appl. No.: 15/366,297

(22) Filed: Dec. 1, 2016

(65) Prior Publication Data

US 2017/0171662 A1 Jun. 15, 2017

Related U.S. Application Data

(60) Provisional application No. 62/265,569, filed on Dec. 10, 2015.

(51) Int. Cl.
*H04R 9/04* (2006.01)
*H04R 9/06* (2006.01)
*H04R 29/00* (2006.01)

(52) U.S. Cl.
CPC ..... *H04R 9/041* (2013.01); *H04R 9/06* (2013.01); *H04R 29/003* (2013.01)

(58) Field of Classification Search
CPC ..... G02B 27/646; G02B 5/005; H04R 9/025; H04R 1/288; H04R 2400/03; H04R 9/043; H04R 2307/201; H04R 29/003; H04R 7/16; H04R 7/26
See application file for complete search history.

(56) References Cited

U.S. PATENT DOCUMENTS

| | | | | |
|---|---|---|---|---|
| 5,682,436 | A | 10/1997 | Sakamoto et al. | |
| 7,961,892 | B2 | 6/2011 | Fedigan | |
| 8,008,813 | B2 | 8/2011 | Keating | |
| 8,284,982 | B2 | 10/2012 | Bailey | |
| 8,690,325 | B1 * | 4/2014 | Straus | A61B 5/1171 349/12 |
| 9,130,445 | B1 | 9/2015 | Katz et al. | |
| 2006/0188120 | A1 | 8/2006 | Fisher | |
| 2015/0077324 | A1 * | 3/2015 | Birnbaum | G06F 3/016 345/156 |
| 2015/0365568 | A1 * | 12/2015 | Topliss | G02B 7/08 348/360 |

* cited by examiner

*Primary Examiner* — Mohammad Islam
(74) *Attorney, Agent, or Firm* — Bereskin & Parr LLP/S.E.N.C.R.L., s.r.l.

(57) ABSTRACT

Acoustic transducer systems involving tilt control, and methods for operating the acoustic transducer systems, are described herein. An example acoustic transducer system includes: a driver motor to generate a magnetic flux; a diaphragm operably coupled to the driver motor; a voice coil structure coupled to the diaphragm and movable in response to the magnetic flux, the voice coil structure includes: a former; a voice coil coupled to the former and movable in response to an input audio signal; and a tilt control coil coupled to the former; a tilt sensing module coupled to the voice coil structure and detects a misalignment of the voice coil structure relative to an initial alignment of the voice coil structure; and a controller for transmitting the input audio signal to the voice coil; and generating and transmitting a correction signal to the tilt control coil for minimizing the misalignment of the voice coil structure.

23 Claims, 17 Drawing Sheets

ACOUSTIC TRANSDUCER SYSTEMS WITH TILT CONTROL

CROSS-REFERENCE TO RELATED PATENT APPLICATION

The application claims the benefit of U.S. Provisional Application No. 62/265,569, filed on Dec. 10, 2015. The complete disclosure of U.S. Provisional Application No. 62/265,569 is incorporated herein by reference.

FIELD

The described embodiments relate to acoustic transducer systems and in particular, some embodiments relate to acoustic transducer systems involving tilt control.

BACKGROUND

Acoustic transducer systems can operate to convert electrical signals into output audio signals. The design topology of the acoustic transducer systems can affect its performance.

Common acoustic transducer systems involve a voice coil that receives the electrical signals from an audio source. The signal at the voice coil can then cause a magnetic flux to be generated at the voice coil in the driver motor of the acoustic transducer system. The diaphragm can then move in response to the magnetic flux to generate the output audio signal.

The voice coil in the acoustic transducer systems can be provided using different topologies. The voice coil can be coupled with the diaphragm and can be configured to move at least partially within an air gap of the acoustic transducer motor. In an example topology, the voice coil can be underhung, which can increase the efficiency of the acoustic transducer system due to the lighter voice coil and lower resistance associated with a shorter voice coil. Another topology can involve an overhung voice coil, which can be characterized by decreased efficiency as compared to the underhung design, but can generate a more linear output audio signal at higher displacement.

The voice coil can also be provided in an evenly hung topology. In comparison with the overhung and underhung topologies, the evenly hung voice coil can offer a more efficient performance but the performance can be limited by distortions caused by the displacement of the voice coil.

SUMMARY

The various embodiments described herein generally relate to acoustic transducer systems and methods for operating the acoustic transducer systems. In particular, the acoustic transducer systems and methods described herein involve tilt control.

In accordance with some embodiments, there is provided an acoustic transducer system including a driver motor operable to generate a magnetic flux; a diaphragm operably coupled to the driver motor; a voice coil structure coupled to the diaphragm, the voice coil structure being movable at least in response to the magnetic flux, and the voice coil structure comprising: a former; a voice coil coupled to the former and the voice coil movable at least in response to an input audio signal; and a tilt control coil coupled to the former; a tilt sensing module coupled to the voice coil structure, the tilt sensing module detecting a misalignment of the voice coil structure relative to an initial alignment of the voice coil structure; and a controller coupled to the driver motor and the tilt sensing module, the controller being operable to: transmit the input audio signal to the voice coil; generate a correction signal based at least on the misalignment detected by the tilt sensing module; and transmit the correction signal to the tilt control coil, the correction signal causing the tilt control coil to generate a corrective force for minimizing the misalignment of the voice coil structure.

In some embodiments, the driver motor includes: an axial post; a top plate having an interior surface facing a portion of the axial post, the top plate and the axial post defining an air gap therebetween; a bottom plate extending from the axial post; and a magnetic element positioned between the bottom plate and the top plate, the magnetic element being operable to generate the magnetic flux; and the voice coil structure is movable at least partially within the air gap.

In some embodiments, the driver motor includes: an axial post; a top plate having an interior surface facing a portion of the axial post, the top plate and the axial post defining an air gap therebetween; a bottom plate extending from the axial post; an outer wall coupled between the top plate and the bottom plate; and a magnetic element positioned between the bottom plate and the axial post, the magnetic element being operable to generate the magnetic flux; and the voice coil structure is movable at least partially within the air gap.

In some embodiments, the tilt sensing module includes a first tilt sensing component, the first tilt sensing component operating to detect the misalignment of the voice coil structure at a first section of the voice coil structure; and the tilt control coil includes a first tilt coil segment for generating a corrective force in response to the correction signal, the corrective force minimizing the misalignment of the voice coil structure in a first axis of rotation.

In some embodiments, the tilt sensing module includes: a second tilt sensing component operating to detect the misalignment of the voice coil structure at a second section of the voice coil structure, the first section being different from the second section; the controller being operable to generate the correction signal based on the misalignment detected by the first and second tilt sensing components at the respective first and second sections of the voice coil structure; and the first tilt coil segment generating the corrective force in response to the correction signal for minimizing the misalignment of the voice coil structure in at least one of the first axis of rotation and a second axis of rotation, the second axis of rotation being orthogonal to the first axis of rotation.

In some embodiments, the tilt control coil further includes a second tilt coil segment, each of the first tilt coil segment and the second tilt coil segment generating a respective corrective force in response to the correction signal, and the respective corrective force minimizing the misalignment of the voice coil structure in at least one of the first axis and the second axis.

In some embodiments, the corrective force generated by the first tilt coil segment is different from the corrective force generated by the second tilt coil segment.

In some embodiments, the tilt sensing module includes: a third tilt sensing component operating to detect the misalignment of the voice coil structure at a third section of the voice coil structure, the third section being different from the first section and the second section; the controller being operable to generate the correction signal based on the misalignment detected by the first, the second and the third tilt sensing components at the respective first, second and third sections of the voice coil structure; and the first tilt coil segment generating the corrective force in response to the correction signal for minimizing the misalignment of the voice coil structure in the first axis of rotation, the second axis of rotation, and a third axis of rotation orthogonal to the first and the second axes of rotation.

In some embodiments, the tilt control coil further includes a second tilt coil segment, each of the first tilt coil segment and the second tilt coil segment generating a respective corrective force in response to the correction signal, and the respective corrective force minimizing the misalignment of the voice coil structure in at least one of the first axis, the second axis, and the third axis.

In some embodiments, the tilt control coil further includes a third tilt coil segment, each of the first, second and third tilt coil segments generating a respective corrective force in response to the correction signal, and the respective corrective force minimizing the misalignment of the voice coil structure in at least one of the first axis, the second axis, and the third axis.

In some embodiments, at least one of the respective corrective forces is different from one of the other respective corrective force.

In some embodiments, the tilt control coil is mounted radially along a circumference of the former of the voice coil structure.

In some embodiments, the tilt control coil includes two or more tilt coil segments, the two or more tilt coil segments being mounted substantially equidistant along the circumference of the former of the voice coil structure.

In some embodiments, the tilt sensing module includes at least one pair of tilt sensing components, the at least one pair of tilt sensing components being positioned substantially opposite from each other.

In some embodiments, the tilt sensing module includes at least one pair of tilt sensing components, the at least one pair of tilt sensing components being positioned substantially orthogonal to each other.

In some embodiments, the tilt control coil is formed at an exterior surface of the former of the voice coil structure.

In some embodiments, the tilt control coil is formed at an interior surface of the former of the voice coil structure.

In some embodiments, the tilt control coil includes a conductive layer.

In some embodiments, the tilt control coil includes a conductive wire.

In some embodiments, the tilt control coil is coupled with the voice coil.

In some embodiments, the tilt sensing module includes at least one of a strain sensor, an accelerometer and an optical sensor.

In some embodiments, an optical pattern is provided at a top surface of the diaphragm; and the tilt sensing module includes an optical sensor for capturing images of the optical pattern during operation of the driver motor, and the tilt sensing module operating to compare one or more images of the optical pattern with the optical pattern at the initial alignment for detecting the misalignment.

In some embodiments, the controller is electronically coupled to at least one of the driver motor and the tilt sensing module.

In accordance with some embodiments, there is provided a method for operating an acoustic transducer, the method including: operating a driver motor to generate a magnetic flux; receiving an input audio signal and transmitting the input audio signal to a voice coil, the voice coil being movable at least in response to the magnetic flux and the input audio signal, and the voice coil being provided at a voice coil structure coupled to a diaphragm; detecting, by a tilt sensing module, a misalignment of the voice coil structure relative to an initial alignment of the voice coil structure; generating, by a controller coupled to the driver motor and the tilt sensing module, a correction signal based at least on the misalignment detected by the tilt sensing module; and transmitting the correction signal to a tilt control coil coupled to the voice coil structure, the correction signal causing the tilt control coil to generate a corrective force for minimizing the misalignment of the voice coil structure.

In some embodiments, generating the correction signal includes: receiving a misalignment signal from the tilt sensing module, the misalignment signal representing the misalignment of the voice coil structure relative to the initial alignment of the voice coil structure; determining the misalignment with respect to the initial alignment of the voice coil structure from the misalignment signal; and determining the corrective force to be generated by the tilt control coil for minimizing the misalignment of the voice coil structure.

In some embodiments, generating the correction signal includes: in response to receiving the misalignment signal, determining whether the misalignment exceeds a misalignment tolerance range; and in response to determining the misalignment exceeds the misalignment tolerance range, determining the corrective force to be generated by the tilt control coil for minimizing the misalignment of the voice coil structure, otherwise, generating a null signal for causing no movement of the voice coil structure by the tilt control coil.

In some embodiments, the methods described herein include: detecting the misalignment at a first section of the voice coil structure; and determining a corrective force for minimizing the misalignment of the voice coil structure in a first axis of rotation.

In some embodiments, the methods described herein include: detecting the misalignment at a second section of the voice coil structure, the first section being different from the second section; and determining the corrective force for minimizing the misalignment of the voice coil structure in at least one of the first axis and a second axis orthogonal to the first axis.

In some embodiments, the methods described herein include: receiving, at the controller, a mode selection input for selectively operating the acoustic transducer in a first mode and a second mode different from the first mode; in response to receiving the mode selection input corresponding to the first mode, the controller operates to: transmit the input audio signal to the voice coil; and generate the correction signal in response to the detected misalignment of the voice coil structure and transmit the correction signal to the tilt control coil; and in response to receiving the mode selection input corresponding to the second mode, the controller operates to: transmit the input audio signal to the voice coil and the tilt control coil.

In some embodiments, the methods described herein include, in response to receiving the mode selection input corresponding to the second mode, the controller operates to transmit a version of a combination of the input audio signal and the correction signal to the tilt control coil.

In some embodiments, the controller is electronically coupled to at least one of the driver motor and the tilt sensing module.

BRIEF DESCRIPTION OF THE DRAWINGS

Several embodiments will now be described in detail with reference to the drawings, in which.

Figure 1:
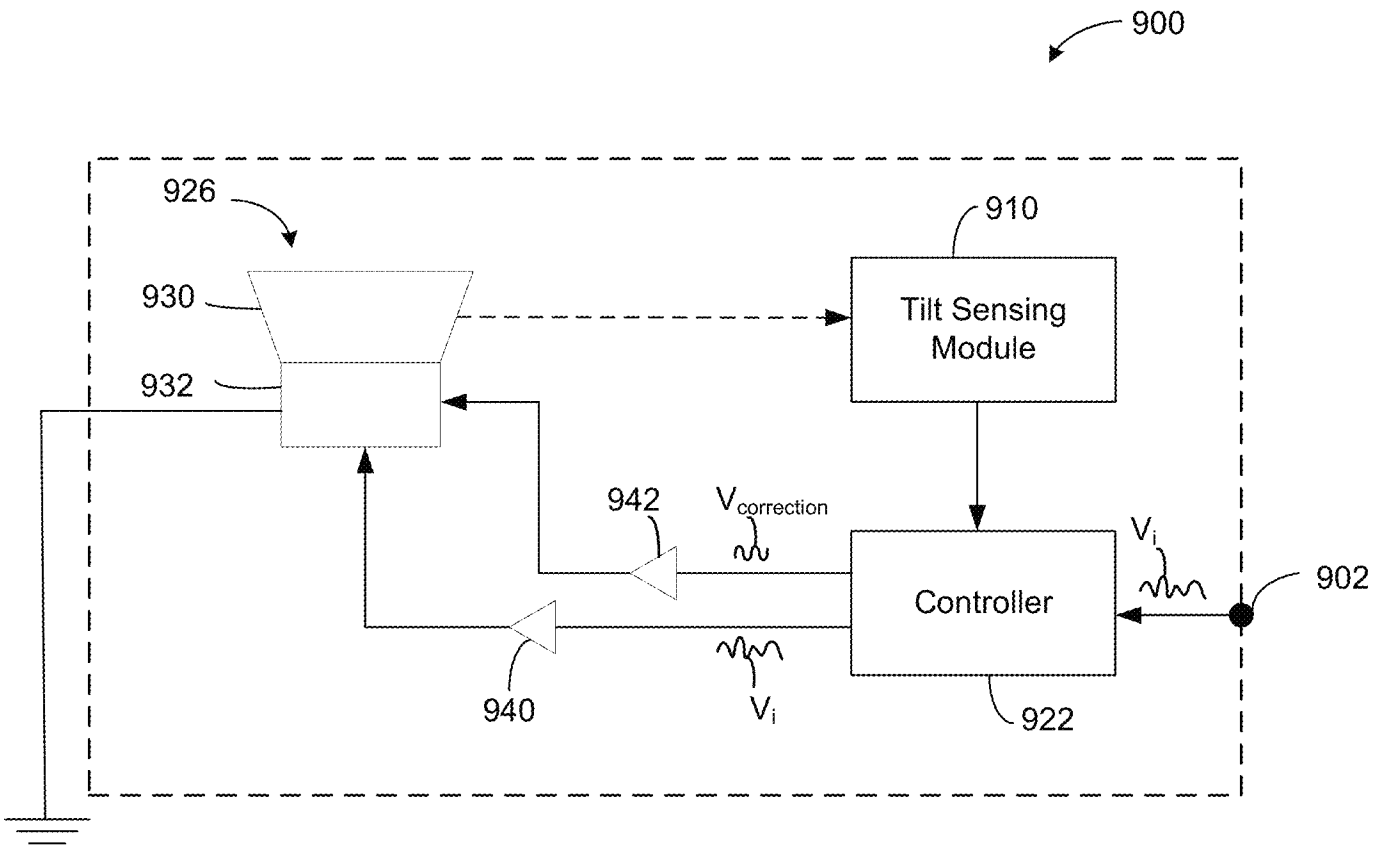
FIG. 1 is a block diagram of an acoustic transducer system in accordance with an example embodiment.

The drawings, described below, are provided for purposes of illustration, and not of limitation, of the aspects and features of various examples of embodiments described herein. For simplicity and clarity of illustration, elements shown in the drawings have not necessarily been drawn to scale. The dimensions of some of the elements may be exaggerated relative to other elements for clarity. It will be appreciated that for simplicity and clarity of illustration, where considered appropriate, reference numerals may be repeated among the drawings to indicate corresponding or analogous elements or steps.

DESCRIPTION OF EXAMPLE EMBODIMENTS

It will be appreciated that numerous specific details are set forth in order to provide a thorough understanding of the example embodiments described herein. However, it will be understood by those of ordinary skill in the art that the embodiments described herein may be practiced without these specific details. In other instances, well-known methods, procedures and components have not been described in detail so as not to obscure the embodiments described herein. Furthermore, this description and the drawings are not to be considered as limiting the scope of the embodiments described herein in any way, but rather as merely describing the implementation of the various embodiments described herein.

It should be noted that terms of degree such as "substantially", "about" and "approximately" when used herein mean a reasonable amount of deviation of the modified term such that the end result is not significantly changed. These terms of degree should be construed as including a deviation of the modified term if this deviation would not negate the meaning of the term it modifies.

In addition, as used herein, the wording "and/or" is intended to represent an inclusive-or. That is, "X and/or Y" is intended to mean X or Y or both, for example. As a further example, "X, Y, and/or Z" is intended to mean X or Y or Z or any combination thereof.

It should be noted that the term "coupled" used herein indicates that two elements can be directly coupled to one another or coupled to one another through one or more intermediate elements. The term "coupled" can, in some embodiments, also indicate that the two elements are integrally formed.

FIG. 1 is a block diagram of an example acoustic transducer system 900. The acoustic transducer system 900 includes a controller 922, a tilt sensing module 910 and a driver 926. The driver 926, as shown, includes at least a diaphragm 930 operably coupled to a driver motor 932.

The controller 922 is coupled to the driver 926 and the tilt sensing module 910. The controller 922 may be coupled to the driver 926 and/or the tilt sensing module 910 electronically, such as a wireless coupling. The controller 922 may be implemented in software or hardware, or a combination thereof. The hardware may be digital or analog, or a combination thereof.

The controller 922 can receive the input audio signal ($V_i$) from an input terminal 902 and transmit the input audio signal to the voice coil at the driver 926 via an amplifier component 940. The input terminal 902 can be coupled to an audio source (not shown) for providing the input audio signal. The input audio signal may be an analog or digital signal. The input audio signal may be a one volt peak-to-peak signal with a time varying magnitude and a time-varying frequency. In other embodiments, the input audio signal may be any other type of analog and/or digital audio signal.

The driver motor 932 can operate to generate a magnetic flux. The voice coil structure (not shown) in the driver motor 932 can then move in response to the magnetic flux. The voice coil structure, however, can move in undesired directions due to a variety of factors, such as a topology of the driver motor 932 and/or environmental changes inside and outside the driver motor 932. For example, aspects of the topology of the driver motor 932 that can affect the movement of the voice coil structure can include the radiating movement of the diaphragm 930, a configuration of the suspension assembly with respect to the voice coil structure, or an absence of the motor suspension assembly from the driver motor 932. The undesired movements of the voice coil structure can cause collisions between the voice coil structure itself and other components of the driver motor 932, which can result in mechanical damage to the voice coil and produce audible artifacts that are not representative of the desired output signal. The undesired movements can occur in one or more different axes of rotation and can be referred to as a wobble, rock, or tilt of the voice coil structure. For ease of reference, the undesired movement of the voice coil structure will be referred to as a tilt of the voice coil structure herein. The voice coil structure is more likely to exhibit a tilt in acoustic speakers systems in which the diaphragm 930 is not supported by a motor suspension component, such as a spider assembly or other similar components, although acoustic speaker systems that include a spider assembly or other motor suspension may exhibit tilt and the acoustic transducer systems described herein may be used with such acoustic speaker systems.

Figure 2A:
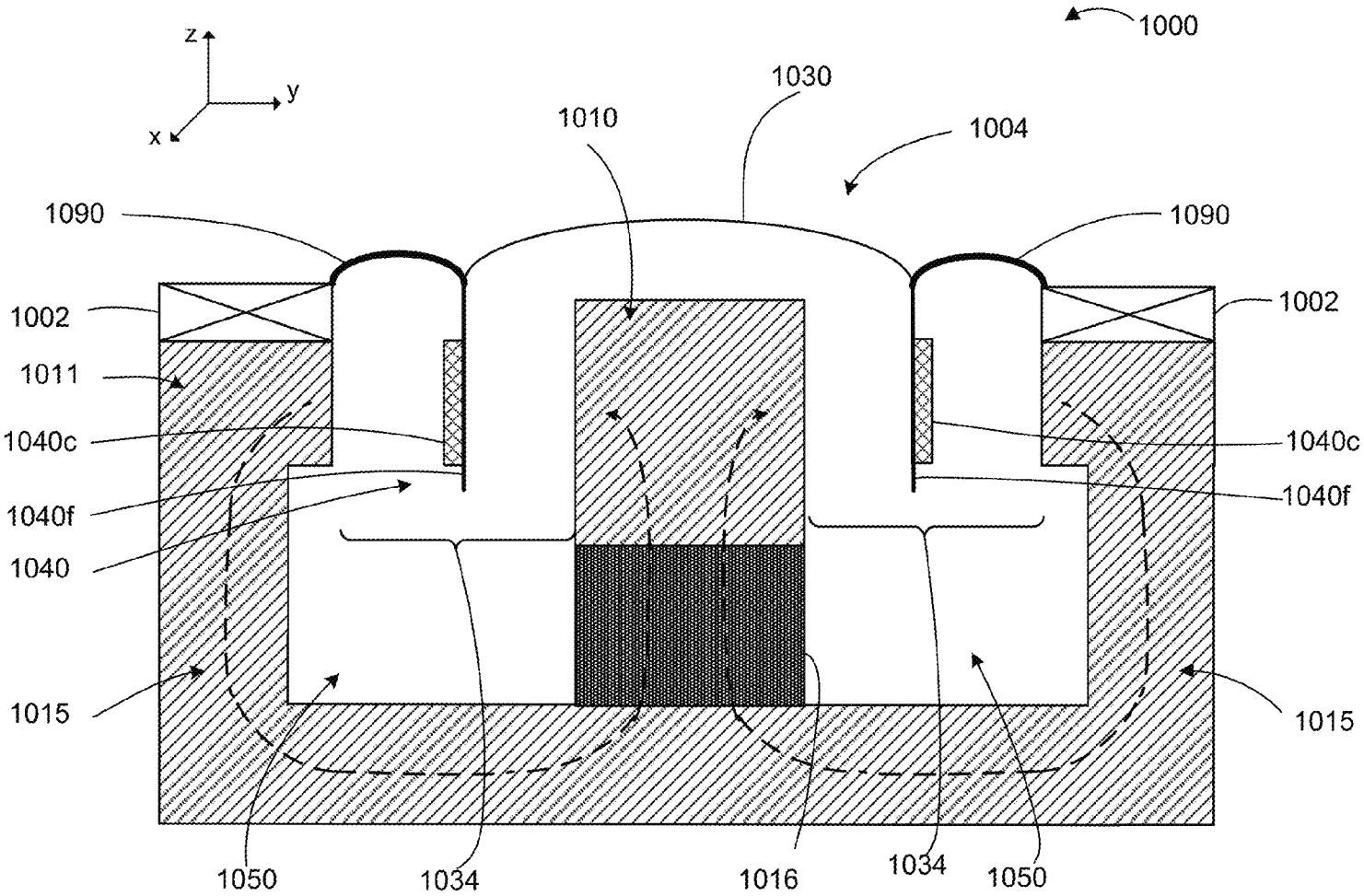
FIG. 2A is a cross-sectional drawing illustrating a prior art driver.
Figure 2B:
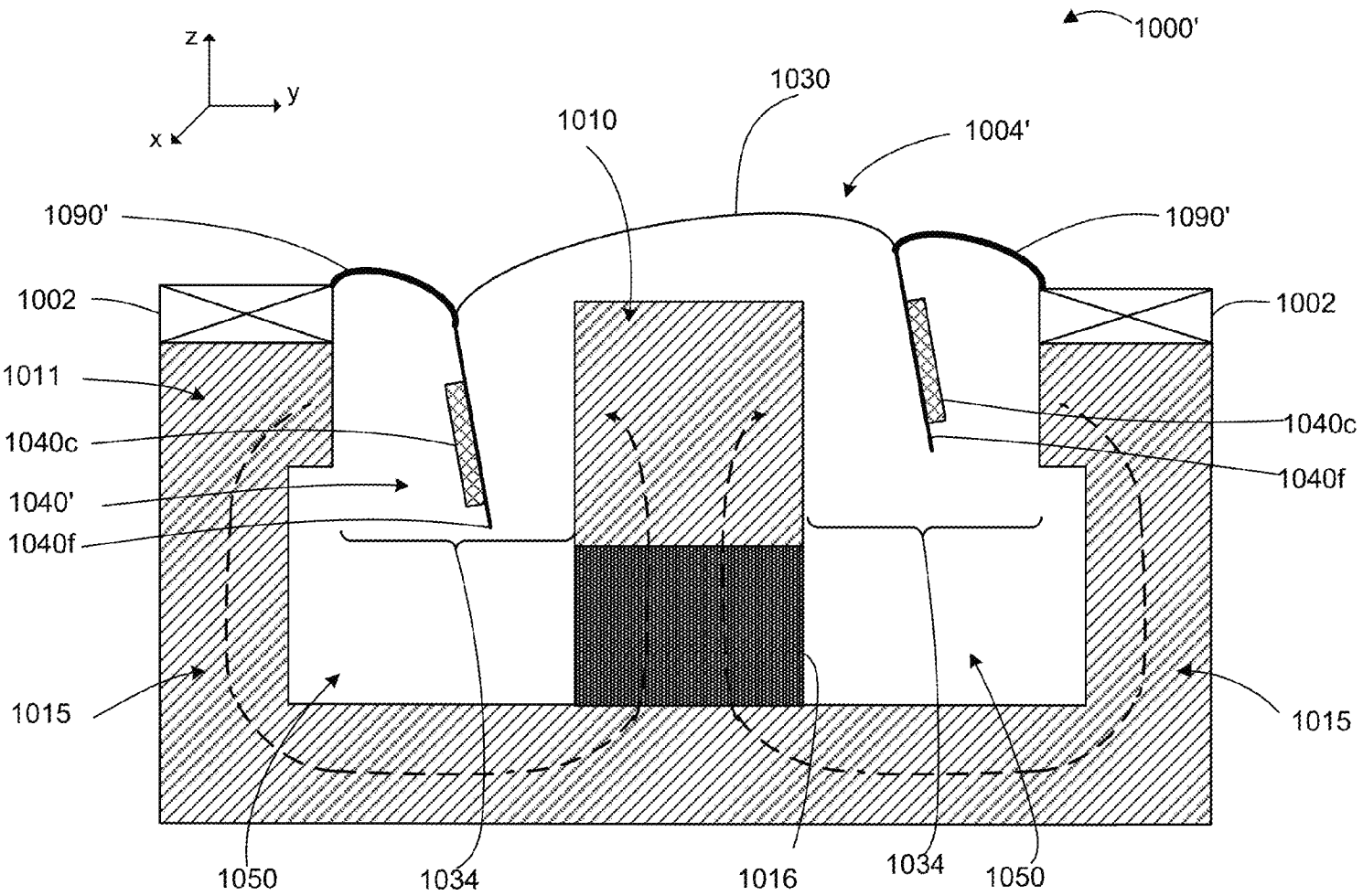
FIG. 2B shows the prior art driver of FIG. 2A during an example operation.

FIGS. 2A and 2B show a prior art micro driver 1000 at different operating states.

For ease of reference, the driver 1000 shown in FIGS. 2A and 2B is shown with reference to the Cartesian coordinate system. Other coordinate systems may similarly be used.

Micro drivers 1000 generally do not include a motor suspension component, such as a spider. Micro drivers 1000 can typically be used in low profile electronic devices, such as flat panel televisions, sound bars, and handheld devices, since the absence of the motor suspension component can conserve space.

The driver 1000 includes an axial post 1010 and a wall 1011. The axial post 1010 and the wall 1011 are coupled with a magnetic element 1016 to form a magnetic circuit 1015. A portion of the wall 1011 and a portion of the axial post 1010 define an air gap 1034 that is part of the magnetic circuit 1015. A driver cavity 1050 is also provided by spacing the magnetic element 1016 and the axial post 1010 away from the wall 1011.

A surround 1090 acts as a flexible mechanical coupling between a frame 1002 and a diaphragm 1030 of the driver 1000. The surround 1090 may be ring-shaped, in some embodiments. A voice coil structure 1040 is operably coupled to the diaphragm 1030 and moves at least partially within the air gap 1034 axially with respect to the driver 1000 or, with reference to the coordinate system of FIG. 2A, the voice coil structure 1040 is designed to move in the z-axis. The voice coil structure 1040 includes a former 1040*f* around which a voice coil 1040*c* can be wound. The voice coil structure 1040 can move in response to the effect of the magnetic field generated by the magnetic circuit 1015 on the signal applied to the voice coil 1040*c*.

As shown in FIG. 2A, when no current is flowing through the voice coil 1040*c*, the diaphragm 1030 is at an initial position, or a rest position. At the initial position, the alignment of the voice coil structure along the x-y plane can be referred to as an initial alignment, which is illustrated at 1004. FIG. 2B shows the micro driver 1000 of FIG. 2A during an example operation and is illustrated at 1000'.

While the driver 1000 is operating, the voice coil structure 1040 can tilt relative to the initial alignment 1004 due, at least, to the absence of a motor suspension component. The tilted voice coil structure is illustrated at 1040'. As shown in FIG. 2B, an alignment of the tilted voice coil structure 1040' is misaligned, or tilted, with respect to the initial alignment 1004. The shifted alignment is illustrated at 1004'. Also, the surround 1090 is also misaligned due to the tilted voice coil structure 1040'. The misaligned surround is illustrated at 1090'.

Due to possible tilting of the voice coil structure 1040, the air gap 1034 in the prior art micro driver 1000 may be designed to be fairly wide to accommodate those shifts in the alignment in order to prevent collisions between the voice coil structure 1040 and components of the driver 1000, such as the wall 1011 and/or the axial post 1010, as much as possible. As a result of the wide air gap 1034, the magnetic field strength (B) will decrease and the overall efficiency of the prior art micro driver 1000 can decrease. As well, the frame 1002 of the prior art micro drivers 1000 may be designed to have a greater depth with respect to the wall 1011 in order to minimize a size of the flexible mechanical interface 1090, which is subjected to the movement of the voice coil structure 1040.

In the acoustic transducer systems 900 described herein, a tilt control coil (not shown in FIG. 1) can operate with the tilt sensing module 910 to minimize the undesired movements of the voice coil structure. In some other embodiments, the voice coil can also act as the tilt control coil and operate with the tilt sensing module 910 to minimize the undesired movements of the voice coil structure.

The tilt sensing module 910 can operate to detect a misalignment of the voice coil structure relative to an initial alignment of the voice coil structure.

As will be described with reference to at least FIGS. 4A to 4G, 5A, 5B, 7A to 7C, 8A and 8B, the tilt sensing module 910 can include one or more tilt sensing components coupled to the voice coil structure. The tilt sensing components can operate to obtain a tilt measurement from at least one section of the voice coil structure so that the tilt of the voice coil structure in at least one axis can be determined. In some embodiments, the tilt sensing module 910 can include two or more tilt sensing components in order to obtain more than one tilt measurement in order to determine the tilt of the voice coil structure with respect to more than one axis of the voice coil structure.

Various implementations of the tilt sensing component may be used. For example, the tilt sensing component can be implemented with a combination of hardware and software that involves measuring the displacement, or measuring other values, such as a velocity measurement by a velocity sensor or an acceleration measurement from an accelerometer, and determining the displacement from that measured value. The displacement can then be determined by taking a derivative of the velocity measurement or an integral of the acceleration measurement. Other example tilt sensing components can be implemented using optical methods (e.g., an optical sensor, such as a laser displacement sensor, an image sensor, a proximity sensor, or a sensor for measuring an angle of rotation), or methods involving measurement of electrical capacitance, inductance or mutual coupling that varies with the displacement of the voice coil structure. The tilt sensing component may also be implemented as a strain sensor, an ultrasonic sensor, a magnetic sensor, an acoustic pressure sensor, and other similar sensors.

Strain sensors, such as strain gauges, for example, can operate based on a bulk or piezoelectric property of a component of the driver 926, such as a suspension component or a mechanical interface between the diaphragm 930 and a frame of the driver 926.

In some embodiments, the tilt sensing component can include a zero-cross sensor and an accelerometer or a velocity sensor. The zero-cross sensor can operate to maintain an average DC position, while a double integral of the accelerometer or single integral of the velocity sensor can indicate a movement of the voice coil structure. The signal from the zero-cross sensor and one of the accelerometer or velocity sensor can be combined. For example, the signals from the zero-cross sensor and one of the accelerometer sensor or velocity sensor can be summed with appropriate filtering and/or scaling.

Based on the detected misalignment, the tilt sensing module 910 can generate a misalignment signal representing the misalignment and transmit the misalignment signal to the controller 922. In some embodiments, the controller 922 can generate the misalignment signal in response to data signals representing the misalignment detected by the tilt sensing module 910. The controller 922 can then generate a correction signal ($V_{correction}$).

In embodiments in which the voice coil can also operate as the tilt control coil, the controller 922 can apply the correction signal also to the voice coil for minimizing the alignment of the voice coil structure. As a result, the voice coil will carry both the input audio signal and the correction signal. A decoder component can be provided at the driver 926 in order to separate the correction signal from the input audio signal.

In some embodiments, the voice coil can be separated into one or more voice coil segments. For example, for a driver, such as 1500A to 1500C, four different voice coil segments can be provided, with a voice coil segment at each side of the rectilinear driver. With this configuration, different correction signals may be provided to each voice coil segment so that each side of the rectilinear driver can be separately adjusted.

In embodiments in which the tilt control coil is used, the controller 922 can apply the correction signal to the tilt control coil for minimizing the alignment of the voice coil structure. The correction signal can be transmitted from the controller 922 to the tilt control coil via an amplifier component 942, for example.

The amplifier components 940 and 942 shown in FIG. 1 buffer, or match, the correction signal (e.g., the type of the signal, and magnitude of the signal) with the requirements of the tilt control coil or voice coil. In embodiments with the tilt control signal, the average power required by the tilt correction system will be less than the audio signal power in the voice coil since the correction signal will be less than the input audio signal.

Figure 3A:
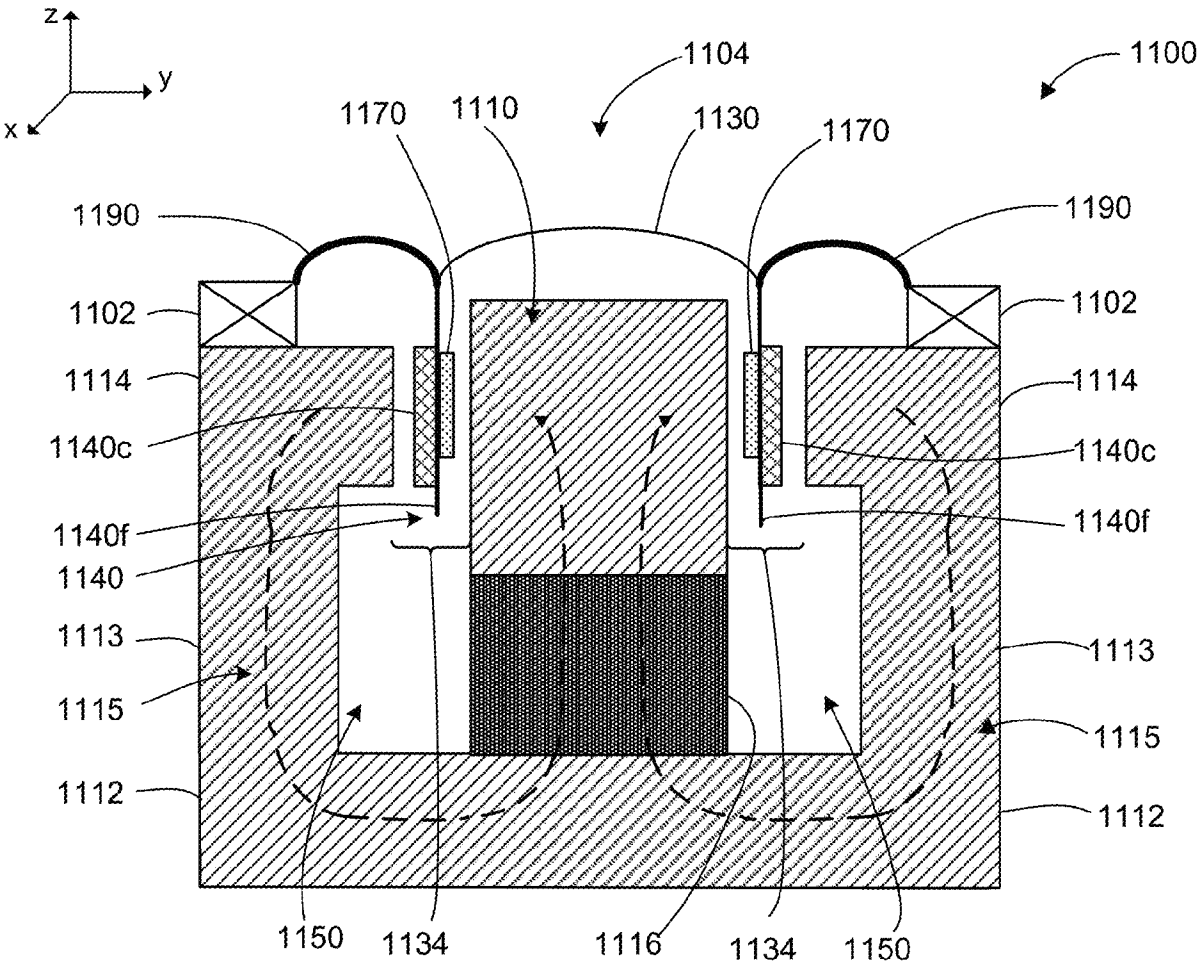
FIG. 3A is a cross-sectional drawing illustrating an example driver operable in some of the acoustic transducer systems described herein.

FIG. 3A shows an example micro driver 1100 operable in at least some of the acoustic transducer systems 900 described herein.

The driver 1100 includes an axial post 1110, a bottom plate 1112 extending in a substantially orthogonal axis from the axial post 1110, and a top plate 1114 with an interior surface facing the axial post 1110. The axial post 1110 may be referred to as a center post since the axial post 1110 is positioned at a substantially central region of the driver 1100.

An outer wall 1113 couples the top plate 1114 to the bottom plate 1112. A magnetic element 1116 can be positioned between the bottom plate 1112 and the axial post 1110 so that the magnetic element 1116 is positioned within the path of the magnetic circuit 1115, or magnetic loop. The magnetic element 1116 and the axial post 1110 can be spaced away from the outer wall 1113 so that a driver cavity 1150 can be provided.

The magnetic element 1116 may be formed from one or more hard magnetic materials, such as, but not limited to, ferrite, neodymium-iron-boron, and Samarium-cobalt. Each of the axial post 1110, the bottom plate 1112, the outer wall 1113 and the top plate 1114 may generally be manufactured from any suitably magnetically permeable materials, such as low carbon steel.

In some other embodiments, the magnetic element 1116 may be provided in the outer wall 1113 between the top plate 1114 and the bottom plate 1112, and the axial post 1110 can be coupled to the bottom plate 1112 directly. The magnetic element 1116 may be positioned substantially centrally between the top plate 1114 and the bottom plate 1112, or closer to one of the top plate 1114 and the bottom plate 1112. In these embodiments, the axial post 1110 may be formed integrally with the bottom plate 1112.

The top plate 1114 and the axial post 1110 define an air gap 1134 therebetween. A voice coil 1140*c* can be wound around a former 1140*f* of a voice coil structure 1140. The voice coil structure 1140 can be operably coupled to the diaphragm 1130 and can move at least partially within the air gap 1134 axially with respect to the driver 1100. According to the coordinate system of FIG. 3A, the voice coil structure 1140 is designed to move in the z-axis. The voice coil structure 1140 can move in response to the effect of the magnetic field generated by the magnetic circuit 1115 on the signal applied to the voice coil 1040*c*.

As shown in FIG. 3A, instead of a motor suspension component, a surround 1190 acts as a flexible mechanical interface between a frame 1102 and the diaphragm 1130 of the driver 1100. Other similar mechanical interfaces can be used instead of the surround 1190 for supporting the moving components of the driver 1100.

When no current is flowing through the voice coil 1140*c*, the voice coil structure 1140 is at an initial position (or rest position). The diaphragm 1130 is also at the rest position. At the initial position, the alignment of the voice coil structure 1140 along the x-y plane can be referred to as an initial alignment, which is illustrated at 1104. The initial alignment 1104 of the voice coil structure 1140 can vary for different designs of the driver 926 and can also vary over the lifetime of acoustic transducer system 900 due to use and/or mechanical degradation of the various system components. When the driver motor 1100 is operating, the voice coil structure 1140 can move relative to the initial position. The diaphragm 1130 also moves with the movement of the voice coil structure 1140 as the diaphragm 1130 is operably coupled to the voice coil structure 1140.

Figure 3B:
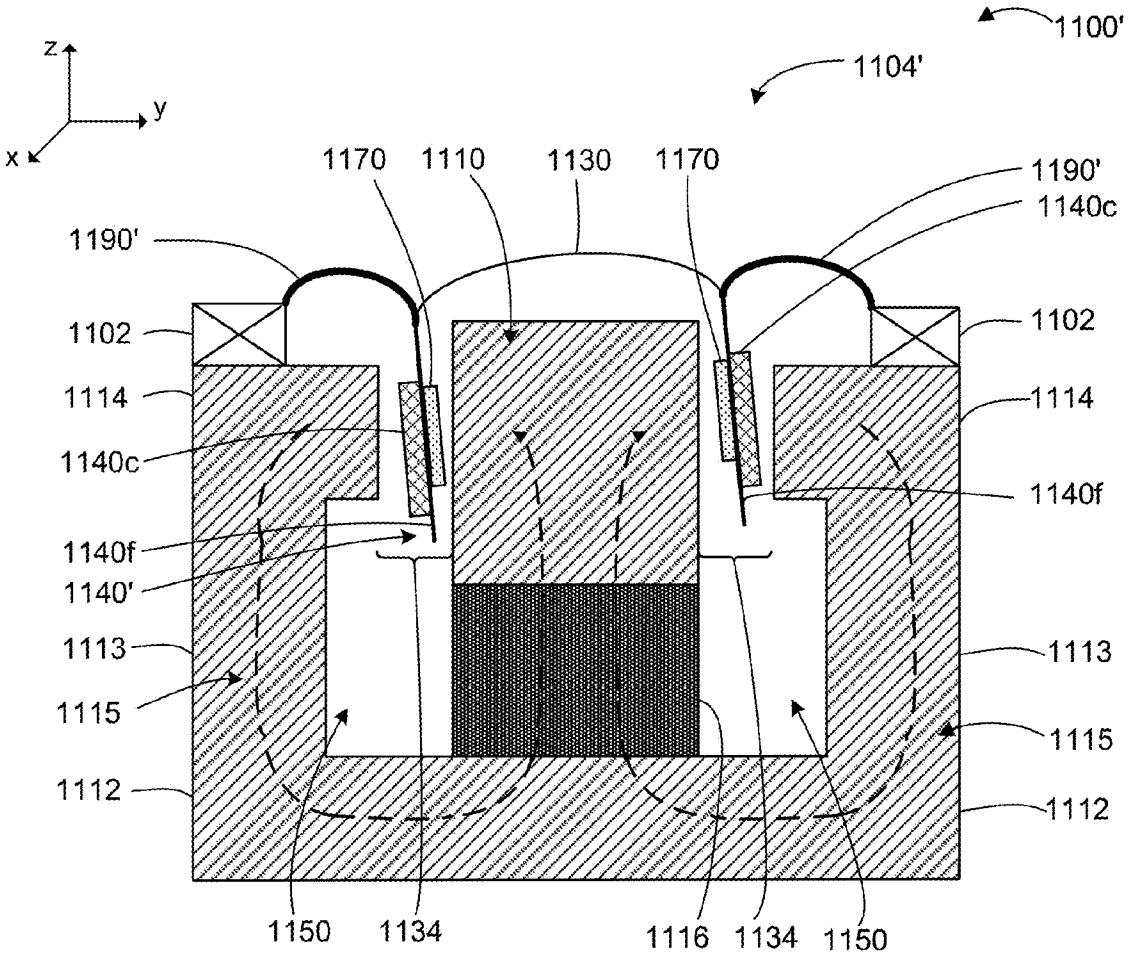
FIG. 3B shows the example driver in FIG. 3A during an example operation.

FIG. 3B shows the driver 1100 of FIG. 3A during an example operation and is illustrated at 1100'. In FIG. 3B, the alignment of the voice coil structure 1140 is shifted with reference to the initial alignment 1104 and is illustrated at 1104'. The tilted voice coil structure is illustrated at 1140'. As shown in FIG. 3B, the diaphragm 1130 is also tilted with the voice coil structure 1140'. Also, the surround 1190 is also misaligned due to the tilted voice coil structure 1140'. The misaligned surround is illustrated at 1190'.

The tilt of the voice coil structure 1140' corresponds to the tilt of the diaphragm 1130 since the voice coil structure 1140' is operably coupled to the diaphragm 1130, and both the voice coil structure 1140' and the diaphragm 1130 are coupled to the surround 1190'.

As can be seen from FIG. 3B, the tilted voice coil structure 1140' can potentially collide with the axial post 1110 during operation of the driver 1100. The misalignment of the voice coil structure 1140' is shown for illustrative purposes, and can vary from the illustration shown in FIG. 3B.

A tilt control coil 1170 is provided in the driver 1100, as shown in FIG. 3A. The tilt control coil 1170 is coupled to the former 1140*f* of the voice coil structure 1140 and therefore, as shown in FIG. 3B, the tilt control coil 1170 also moves with the movement of the voice coil structure 1140'. The controller 922, in response to the misalignment 1104' detected by the tilt sensing module 910, can generate the correction signal and transmit the correction signal to the tilt control coil 1170. The correction signal represents, at least, an amount of corrective force that the tilt control coil 1170 needs to exert in order to minimize the misalignment 1104' of the voice coil structure 1140'.

The tilt control coil 1170 can be characterized by a full turn along a radial circumference of the former 1140*f* of the voice coil structure 1140, or less than a full turn. The tilt control coil 1170 can be formed of a conductive material, such as copper or aluminum.

As will be described with reference to FIGS. 4A to 4G, 5A, 5B, 7A to 7C, 8A and 8B, the tilt control coil 1170 can include one or more tilt coil segments. The tilt coil segments can receive different correction signals from the controller 922 for generating a different respective corrective force that can act on the voice coil structure 1140. With the application of the corrective force to the voice coil structure 1140, the excursion of the voice coil 1140*c* can be maintained substantially within the air gap 1134 in order to maximize the interaction with the magnetic field strength (B) within and near the air gap 1134.

Figure 10:
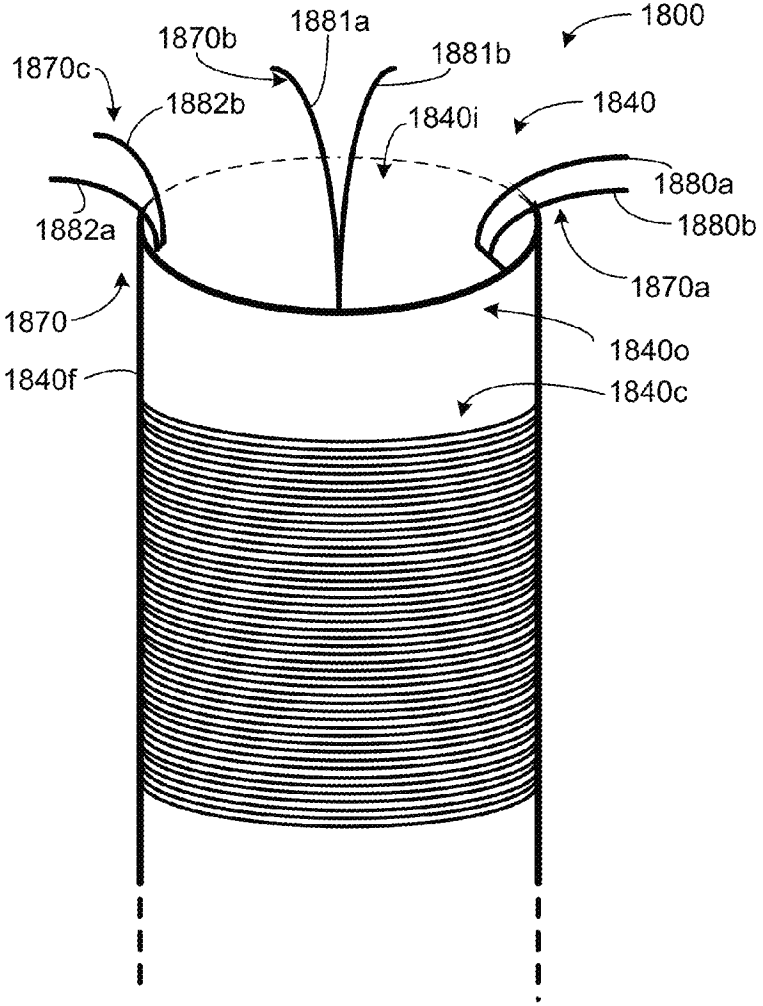
FIG. 10 is a front view of another example voice coil structure in accordance with some of the acoustic transducer systems described herein.
Figure 9:
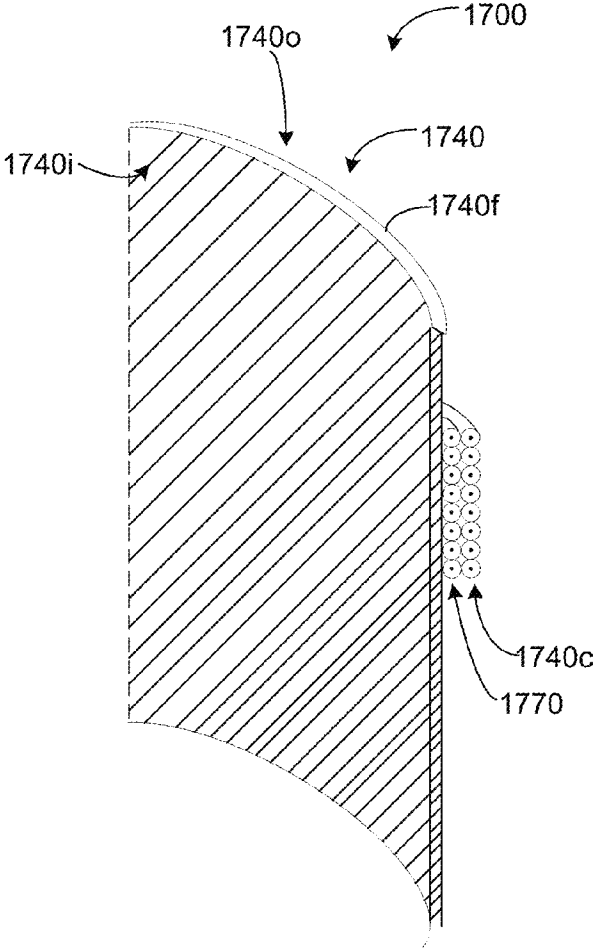
FIG. 9 is a partial side view of a cross-sectional drawing of an example voice coil structure in accordance with some of the acoustic transducer systems described herein.

The tilt coil segments can be provided radially along either an exterior surface of the former 1140*f* of the voice coil structure 1140 (as shown in FIG. 9) or an interior surface of the former 1140*f* of the voice coil structure 1140 (as shown in FIG. 10).

The controller 922 may not generate a correction signal in response to some misalignment signals. For example, the controller 922 can be configured to generate the correction signal only when a collision between the voice coil structure 1140 and the other components of the driver 1100 will likely occur.

Also, depending on the application and/or size of the acoustic transducer system 900, a specific range of tilt of the voice coil structure 1140 may be acceptable because the resulting undesired movement of the voice coil structure 1140 will have minimal effect on the overall performance of the acoustic transducer system 900 or that range of tilt is due to a mechanical defect of the driver 1100. The controller 922 can then be configured to respond to the tilt, or misalignment 1104', of the voice coil structure 1140 that exceeds a misalignment tolerance range. The misalignment tolerance range can define an acceptable range for the tilt of the voice coil structure 1140.

When the controller 922 receives the misalignment signal from the tilt sensing module 910, the controller 922 can determine whether the misalignment exceeds the misalignment tolerance range. If the detected misalignment exceeds the misalignment tolerance range, the controller 922 can then generate a correction signal corresponding to the detected misalignment. The correction signal can then be applied to the tilt control coil 1170 or the voice coil. In response to the correction signal, the tilt control coil 1170 or the voice coil produces a corrective force that acts on the voice coil structure 1140 to counteract the force causing the tilt of the voice coil structure 1140.

As shown in FIG. 1, the controller 922 can apply the correction signal to the tilt control coil 1170 via the amplifier component 942. For example, the amplifier component 942 can be a power amplifier that produces a current in the tilt control coil 1170 that causes the necessary corrective force in response to the correction signal.

However, if the detected misalignment 1104' does not exceed the misalignment tolerance range, the controller 922 can generate a null force that causes no corrective force to act on the voice coil structure 1140 or the controller 922 can simply not generate any signal in response to that detected misalignment 1104'.

In some embodiments, the controller 922 can be configured to be responsive to a predefined frequency range of misalignment signals. The predefined frequency range can vary for different applications and/or size of the acoustic transducer system 900. The controller 922 can apply a filtering operation to the misalignment signal to remove the frequencies that can be ignored. For example, the filtering operation can involve a bandpass filter that can remove the higher frequencies since the corresponding tilt at the voice coil structure 1140 may be negligible, and/or the lower frequencies, which may be representative of a static offset stemming from a mechanical defect of the driver 926 or a force bias within the driver 926 itself.

FIGS. 4A to 4G illustrate top views of partial cross-sectional drawings of example drivers 1200A to 1200G, respectively. Each driver 1200A to 1200G illustrates different configurations of the tilt sensing module 910 and tilt control coil 1170.

The tilt sensing module 910 can include one or more tilt sensing components and the tilt control coil 1170 can include one or more tilt coil segments. The number of tilt coil segments coupled to the former 1140*f* of the voice coil structure 1140 can, in some embodiments, be the same as the number of tilt sensing components. In some other embodiments, the number of tilt coil segments coupled to the former 1140*f* of the voice coil structure 1140 can be fewer or greater than the number of tilt sensing components.

Figure 4B:
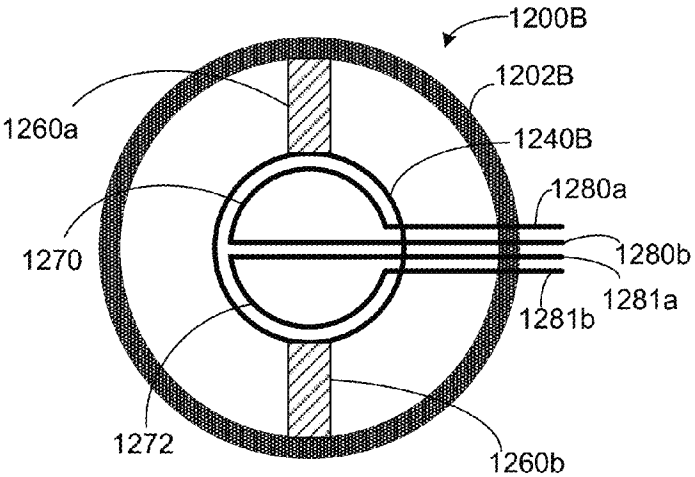
FIG. 4B is a top view of a partial cross-sectional drawing of another example driver in accordance with some of the acoustic transducer systems described herein.
Figure 4A:
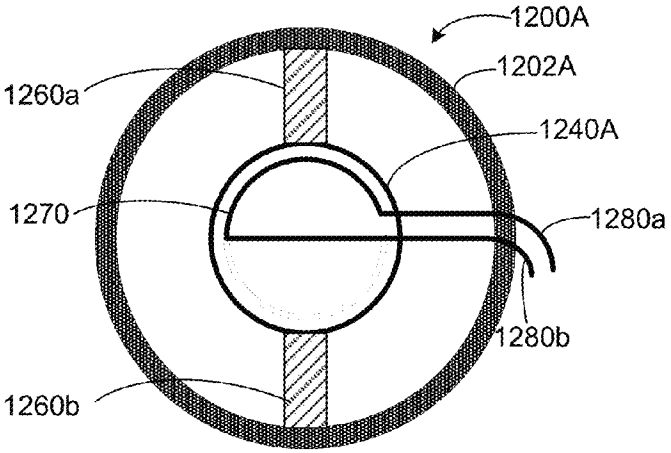
FIG. 4A is a top view of a partial cross-sectional drawing of an example driver in accordance with some of the acoustic transducer systems described herein.

In FIG. 4A, the driver 1200A includes a first tilt sensing component 1260*a* for detecting the misalignment of the voice coil structure 1240A at a first section of the voice coil structure 1240A, and a second tilt sensing component 1260*b* for detecting the misalignment of the voice coil structure 1240A at a second section of the voice coil structure 1240A. Based on the measurements from the first and second tilt sensing components 1260*a* and 1260*b*, the tilt sensing module 910 can determine the tilt of the voice coil structure 1240A in at least a first axis of rotation. For example, with reference to the coordinate system of FIG. 3A, the controller 922 can determine the tilt of the voice coil structure 1240A in the x-axis or y-axis with respect to the x-y plane.

The driver 1200A also includes a tilt coil segment 1270 with signal leads 1280*a*, 1280*b*. The driver 1200A includes a frame 1202A to which the diaphragm 1130 (not shown) is coupled.

The tilt coil segment 1270 is coupled to an interior surface of the former of the voice coil structure 1240A. In some other embodiments, the tilt coil segment 1270 can be coupled to an exterior of the former of the voice coil structure 1240A, or embedded or printed on either the interior or exterior of the former of the voice coil structure 1240A.

The controller 922 can apply the correction signal to the tilt coil segment 1270 via the amplifier component 942 and the signal leads 1280*a*, 1280*b*. In response to the correction signal, the tilt coil segment 1270 can generate a corresponding corrective force to cause the voice coil structure 1240A to move within the air gap 1134 and to also return its alignment to the initial alignment 1104.

Similar to the driver 1200A shown in FIG. 4A, the driver 1200B of FIG. 4B includes the first tilt sensing component 1260*a* and the second tilt sensing component 1260*b*. In contrast, the tilt control coil 1170 includes a first tilt coil segment 1270 and a second tilt coil segment 1272, which are both coupled to an interior surface of the former of the voice coil structure 1240B. In some other embodiments, the tilt coil segments 1270, 1272 can be coupled to an exterior of the former of the voice coil structure 1240B, or embedded or printed on either the interior or exterior of the former of the voice coil structure 1240B. The first tilt coil segment 1270 has signal leads 1280*a* and 1280*b*, and the second tilt coil segment 1272 has signal leads 1281*a* and 1281*b*.

As shown in FIG. 4B, each of the first and second tilt coil segments 1270 and 1272 is positioned relative to the first and second tilt sensing components 1260*a* and 1260*b*. In response to the detected misalignment 1104', the controller 922 can determine a corrective force that needs to be generated by each of the first and second tilt coil segments 1270 and 1272 in order to adjust the alignment of the voice coil structure 1240B, and generate the corresponding correction signal for each of the first and second tilt coil segments 1270 and 1272 accordingly. Depending on the misalignment 1104' at the voice coil structure 1240B, the corrective force to be generated by each of the first and second tilt coil segments 1270 and 1272 may be of different magnitude and direction.

Figure 4C:
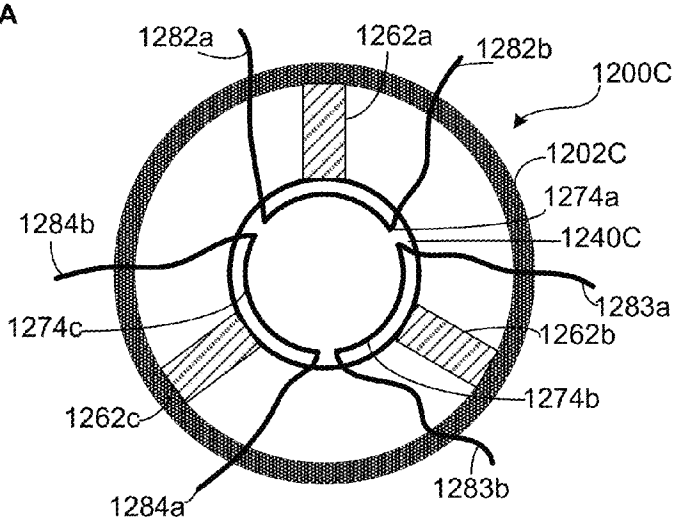
FIG. 4C is a top view of a partial cross-sectional drawing of another example driver in accordance with some of the acoustic transducer systems described herein.

The driver 1200C shown in FIG. 4C includes three tilt sensing components 1262*a*, 1262*b* and 1262*c*, and corresponding tilt coil segments 1274*a*, 1274*b* and 1274*c*.

The tilt sensing components 1262*a*, 1262*b* and 1262*c* can be located radially equidistant from each other along the circumference of the former of the voice coil structure 1240C. Each of the tilt sensing components 1262*a*, 1262*b* and 1262*c* operates to detect a misalignment at a different section of the voice coil structure 1240C. Similar to the driver 1200B, the corrective force that each of the tilt coil segments 1274*a*, 1274*b* and 1274*c* needs to generate may be different and so, the corresponding correction signal applied to each tilt coil segments 1274*a*, 1274*b* and 1274*c* may be of different magnitude and direction.

Providing three tilt sensing components 1262*a*, 1262*b* and 1262*c* can be desirable in some embodiments since three tilt measurements from three different sections of the voice coil structure 1240C is the minimal number required for defining a plane representing the misalignment 1104' of the voice coil structure 1240C. Based on the defined plane representing the misalignment 1104', the controller 922 can determine the attitude adjustment that needs to be made to the voice coil structure 1240C with greater accuracy.

Similar to the drivers 1200A and 1200B, the tilt coil segments 1274*a*, 1274*b* and 1274*c* are coupled to an interior surface of the former of the voice coil structure 1240C. In some other embodiments, the tilt coil segments 1274*a*, 1274*b* and 1274*c* can be coupled to an exterior of the former of the voice coil structure 1240C, or embedded or printed on either the interior or exterior of the former of the voice coil structure 1240C. Each of the tilt coil segments 1274*a*, 1274*b* and 1274*c* also has respective pairs of signal leads 1282*a* and 1282*b*, 1283*a* and 1283*b*, and 1284*a* and 1284*b*.

Figure 4E:
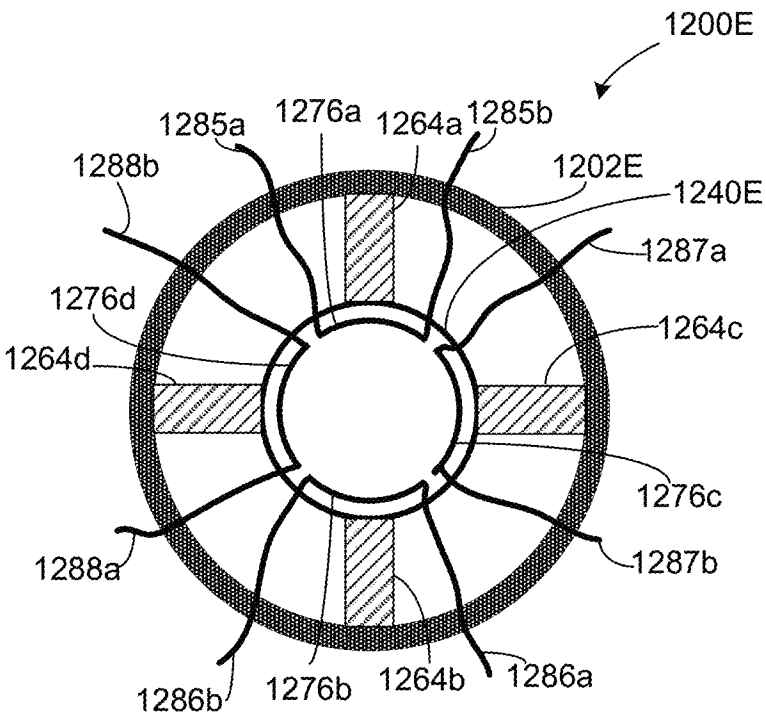
FIG. 4E is a top view of a partial cross-sectional drawing of another example driver in accordance with some of the acoustic transducer systems described herein.
Figure 4D:
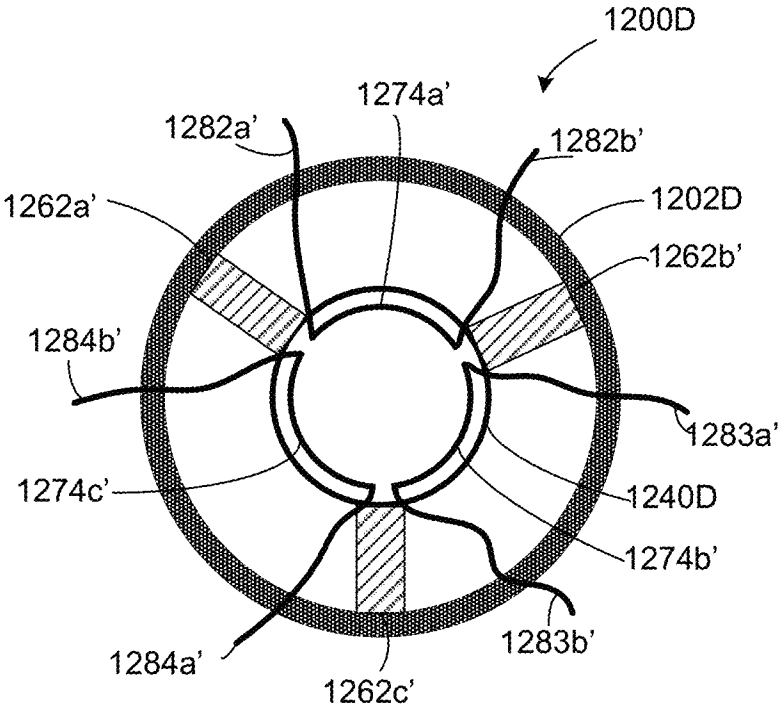
FIG. 4D is a top view of a partial cross-sectional drawing of another example driver in accordance with some of the acoustic transducer systems described herein.
Figure 4G:
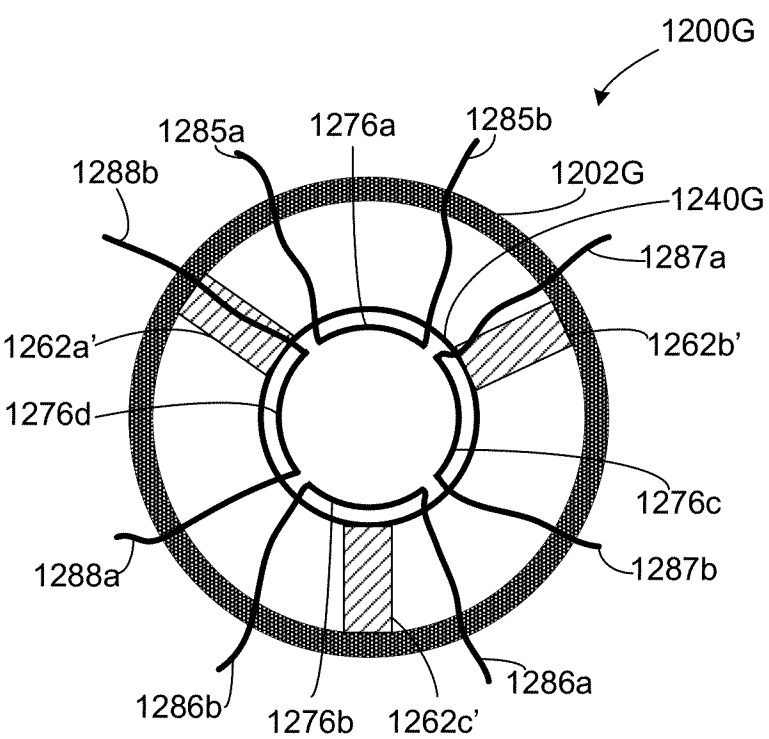
FIG. 4G is a top view of a partial cross-sectional drawing of another example driver in accordance with some of the acoustic transducer systems described herein.

FIG. 4D illustrates another example embodiment of a driver 1200D. The driver 1200D includes the three tilt sensing components 1262*a*', 1262*b*' and 1262*c*' and the tilt coil segments 1274*a*', 1274*b*' and 1274*c*' of the driver 1200C but in a different configuration.

Unlike the configuration of the tilt sensing components 1262*a*, 1262*b* and 1262*c* and the tilt coil segments 1274*a*, 1274*b* and 1274*c* shown in FIG. 4C, the tilt sensing components 1262*a*', 1262*b*' and 1262*c*' are not aligned with the respective tilt coil segments 1274*a*', 1274*b*' and 1274*c*'. The tilt coil segments 1270 shown in the other embodiments described herein can similarly be positioned independently from the respective tilt sensing components 1260. The relative position of the tilt sensing components 1260 and the tilt coil segments 1270 is predefined and so, the controller 922 can process the tilt measurements detected by the respective tilt sensing components 1260 and then, determine the respective corrective force that each of the respective tilt coil segments 1270 needs to exert based on the predefined location of those tilt coil segments 1270.

The driver 1200E shown in FIG. 4E includes four tilt sensing components 1264*a*, 1264*b*, 1264*c* and 1264*d*, and corresponding tilt coil segments 1276*a*, 1276*b*, 1276*c* and 1276*d*. Each of the tilt sensing components 1264*a*, 1264*b*, 1264*c* and 1264*d* operates to detect a misalignment at a different section of the voice coil structure 1240E. By positioning pairs of tilt sensing components, such as 1264*a* and 1264*b*, and 1264*c* and 1264*d*, substantially opposite from each other, the misalignment can be determined with greater accuracy and sensitivity.

The tilt coil segments 1276*a*, 1276*b*, 1276*c* and 1276*d* are also coupled to an interior surface of the former of the voice coil structure 1240E. In some other embodiments, the tilt coil segments 1276*a*, 1276*b*, 1276*c* and 1276*d* can be coupled to an exterior of the former of the voice coil structure 1240E, or embedded or printed on either the interior or exterior of the former of the voice coil structure 1240E. Each of the tilt coil segments 1276*a*, 1276*b*, 1276*c* and 1276*d* also has respective pairs of signal leads 1285*a* and 1285*b*, 1286*a* and 1286*b*, 1287*a* and 1287*b*, and 1288*a* and 1288*b*.

In response to the detected misalignment, the controller 922 can determine a corrective force that needs to be generated by each of the tilt coil segments 1276*a*, 1276*b*, 1276*c* and 1276*d* in order to adjust the alignment of the voice coil structure 1240E. Depending on the misalignment at the voice coil structure 1240E, the corrective force to be generated by each of the tilt coil segments 1276*a*, 1276*b*, 1276*c* and 1276*d* may be of different magnitudes and direction.

Similar to the driver 1200A shown in FIG. 4A, in some embodiments of the drivers 1200 described herein, the number of tilt sensing components 1260 may not be the same as the number of tilt coil segments 1270. The relative position of the tilt sensing components 1260 and the tilt coil segments 1270 is predefined and so, the controller 922 can process the tilt measurements detected by the respective tilt sensing components 1260 and then, determine the respective corrective force that each of the respective tilt coil segments 1270 needs to exert with reference to the position of those tilt coil segments 1270.

Figure 4F:
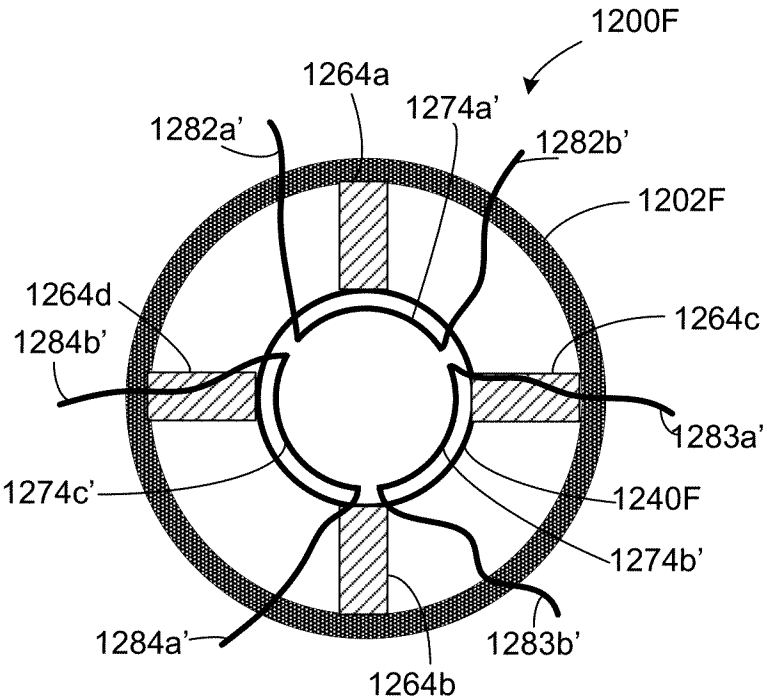
FIG. 4F is a top view of a partial cross-sectional drawing of another example driver in accordance with some of the acoustic transducer systems described herein.

For example, as shown in FIG. 4F, a driver 1200F can include the four tilt sensing components 1264*a*, 1264*b*, 1264*c* and 1264*d* shown in FIG. 4E but include only three tilt coil segments, such as the tilt coil segments 1274*a*', 1274*b*' and 1274*c*' shown in FIG. 4D. In another example, the number of tilt coil segments 1270 can exceed the number of tilt sensing components 1260. For example, the driver 1200G shown in FIG. 4G includes the four tilt coil segments 1276*a*, 1276*b*, 1276*c* and 1276*d* of FIG. 4E, and the three tilt sensing components 1262*a*', 1262*b*' and 1262*c*' of FIG. 4D.

Figure 5B:
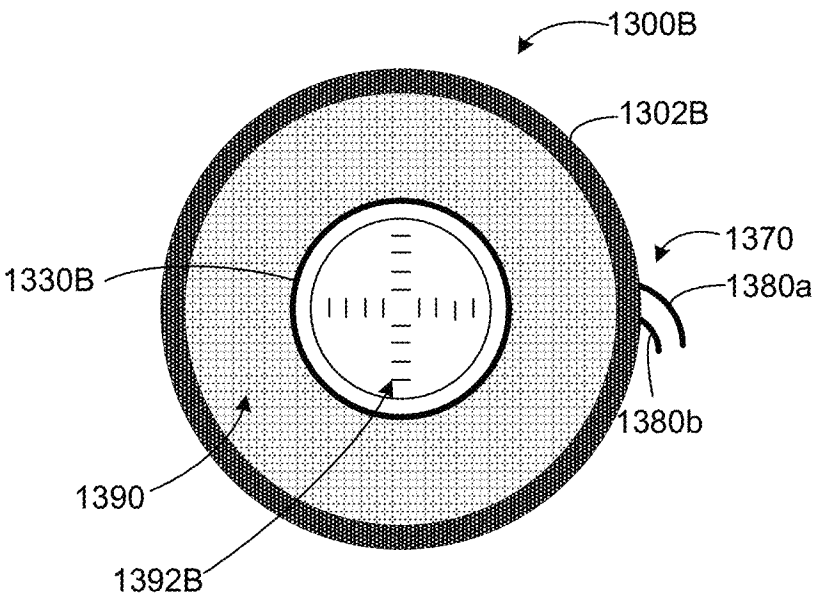
FIG. 5B is a top view of a partial cross-sectional drawing of another example driver in accordance with some of the acoustic transducer systems described herein.
Figure 5A:
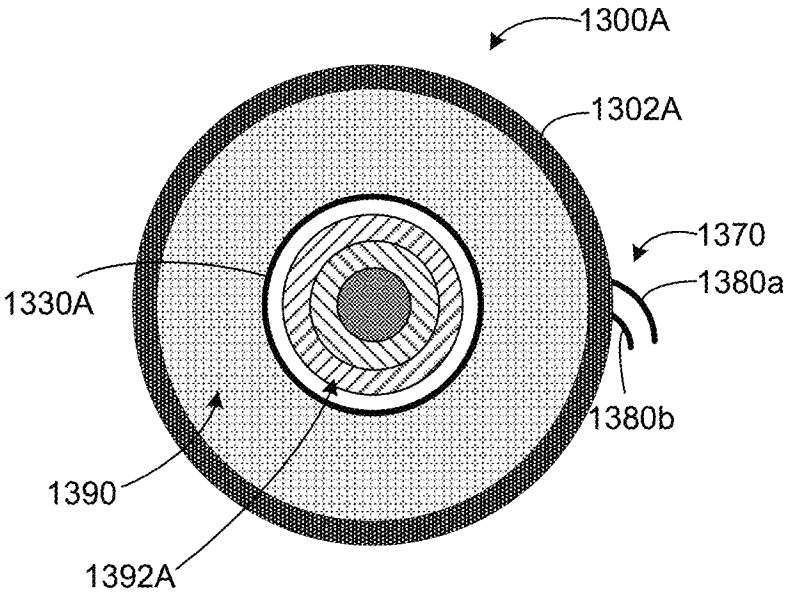
FIG. 5A is a top view of a partial cross-sectional drawing of an example driver in accordance with some of the acoustic transducer systems described herein.

FIGS. 5A and 5B are top views of example drivers 1300A and 1300B, respectively. In the example shown in FIGS. 5A and 5B, optical methods for detecting a tilt of the voice coil structure 1140 are shown.

In FIG. 5A, an optical pattern 1392A is provided on a top surface of the diaphragm 1330A of the driver 1300A. The optical pattern 1392A is characterized by various sized concentric circles. An optical sensor, such as an image sensor, can also be mounted across from the top surface of the diaphragm 1330A, such as on a bottom surface of a cover of the driver 1300A. As the voice coil structure 1140 moves, the optical sensor can capture images of the optical pattern 1392A to monitor the alignment of the voice coil structure 1140. When the voice coil structure 1140 is tilted, the resulting image will show an offset version of the optical pattern 1392A. The tilt sensing module 910, or the controller 922, can then determine the misalignment of the voice coil structure 1140 by comparing the offset version of the optical pattern 1392A with the optical pattern 1392A at the initial alignment 1104 of the voice coil structure 1140.

The optical sensor can be configured to capture one or more images of the optical pattern 1392A at different times during the excursion of the voice coil structure 1140, such as at either peaks of the excursion, a substantially central point of the excursion, or periodically. In some embodiments, the optical sensor can operate based on control signals transmitted from the controller 922.

FIG. 5B shows another optical pattern 1392B that can be provided on the diaphragm 1330B. The tilt sensing module 910, or the controller 922, can then determine the misalignment of the voice coil structure 1140 by comparing the offset version of the optical pattern 1392B with the optical pattern 1392B at the initial alignment 1104 of the voice coil structure 1140.

In some embodiments, the driver 1100 described with reference to FIGS. 3A and 3B may be provided in a rectilinear formation. An example rectilinear micro driver 1400 will now be described with reference to FIGS. 6A and 6B.

Figure 6A:
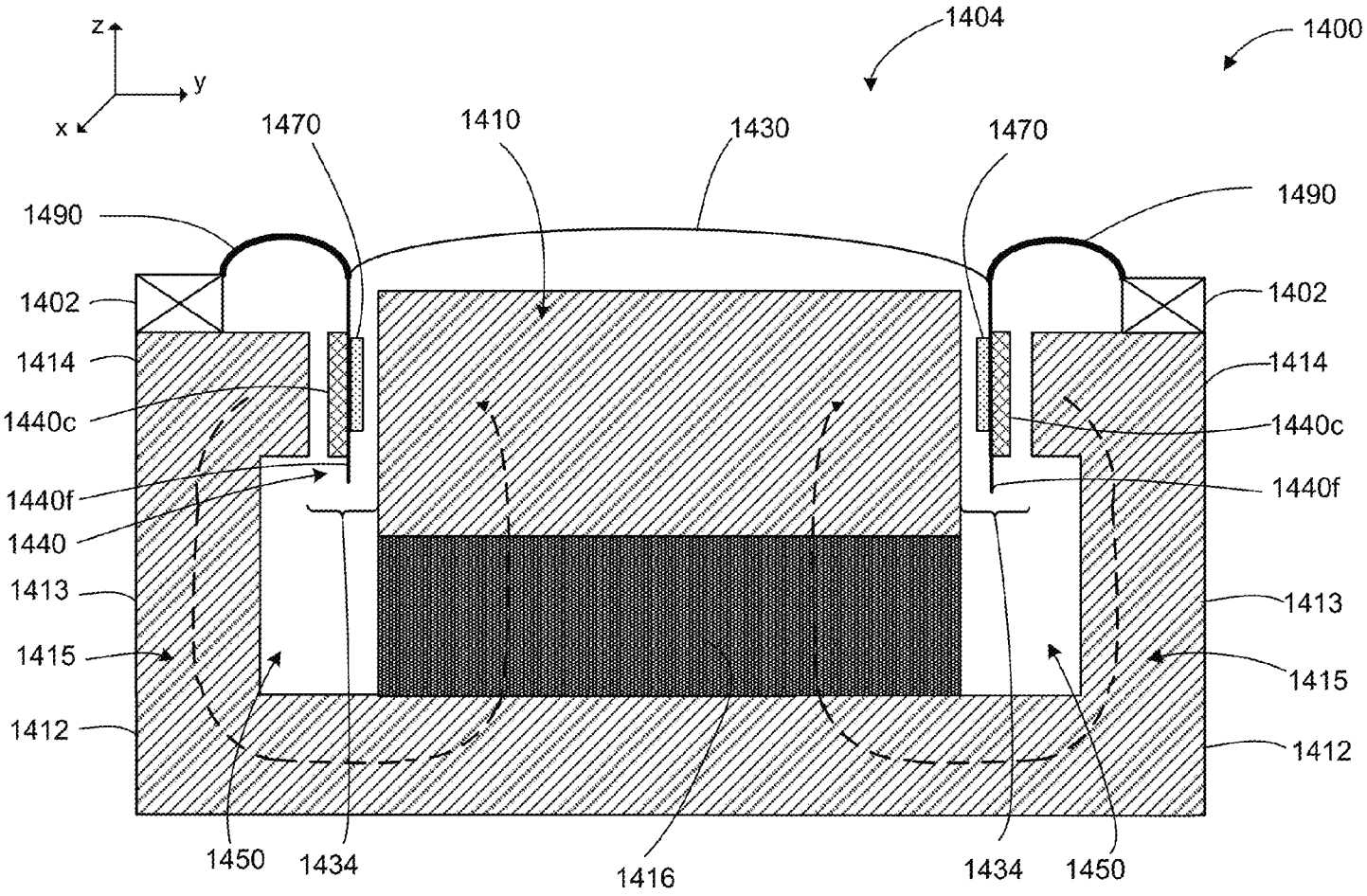
FIG. 6A is a cross-sectional drawing illustrating another example driver operable in some of the acoustic transducer systems described herein.

FIG. 6A shows a cross-section of the micro driver 1400 along the longitudinal end.

The driver 1400 includes an axial post 1410, a bottom plate 1412 extending in a substantially orthogonal axis from the axial post 1410, and a top plate 1414 with an interior surface facing the axial post 1410. An outer wall 1413 couples the top plate 1414 to the bottom plate 1412. A magnetic element 1416 can be positioned between the bottom plate 1412 and the axial post 1410 so that the magnetic element 1416 is positioned within the path of the magnetic circuit 1415. The magnetic element 1416 and the axial post 1410 can be spaced away from the outer wall 1413 so that a driver cavity 1450 can be provided.

The top plate 1414 and the axial post 1410 define an air gap 1434 therebetween. A voice coil 1440*c* can be wound around a former 1440*f* of a voice coil structure 1440. A tilt control coil 1470 is also coupled to the former 1440*f* of the voice coil structure 1440. As shown more clearly in FIGS. 7A to 7C, the voice coil structure 1440 is characterized also by a rectilinear formation.

The voice coil structure 1440 can be operably coupled to the diaphragm 1430 and can move at least partially within the air gap 1434 axially with respect to the driver 1400. With reference to the coordinate system of FIG. 6A, the voice coil structure 1440 is designed to move in the z-axis. The voice coil structure 1440 can move in response to the effect of the magnetic field generated by the magnetic circuit 1415 on the signal applied to the voice coil 1440*c*.

A surround 1490 acts as a flexible mechanical interface between a frame 1402 and a diaphragm 1430 of the driver 1400. Other similar mechanical interfaces can be used instead of the surround 1490 for supporting the diaphragm 1430.

Figure 6B:
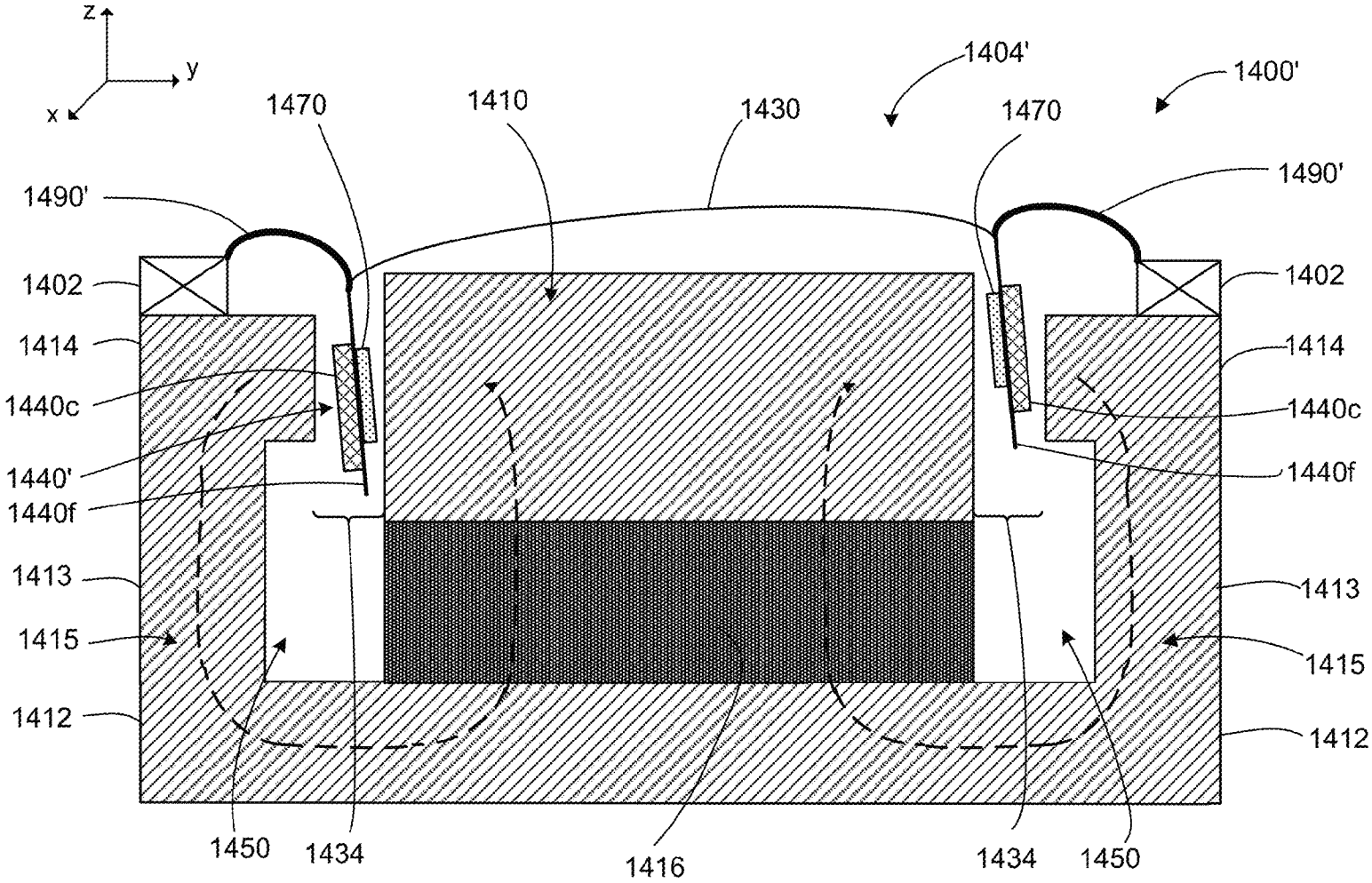
FIG. 6B shows the example driver in FIG. 6A during an example operation.

The voice coil structure 1440 shown in FIG. 6A is in an initial alignment 1404 along the x-y plane, while FIG. 6B shows a tilted voice coil structure 1440' with respect to the x-y plane, as illustrated at 1404'.

Figure 7A:
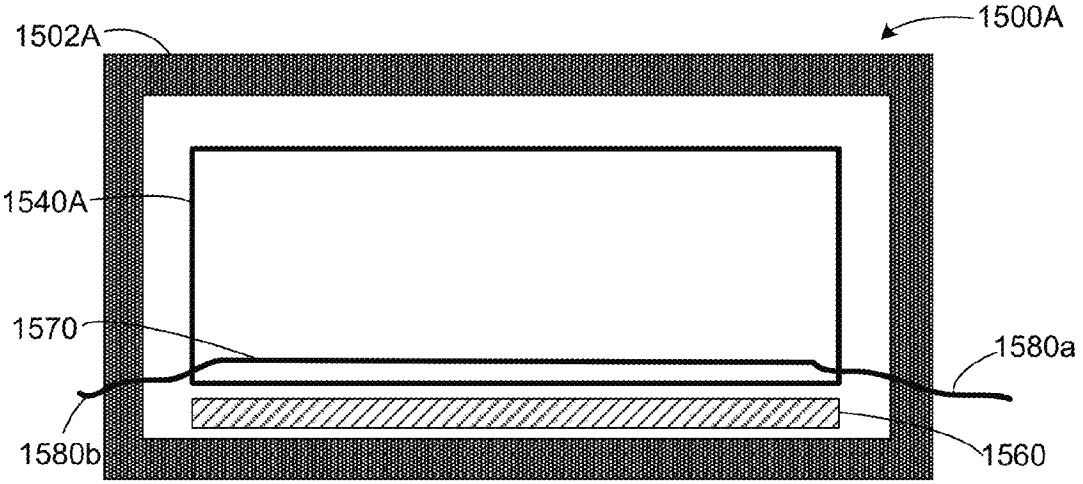
FIG. 7A is a top view of a partial cross-sectional drawing of an example driver in accordance with some of the acoustic transducer systems described herein.
Figure 7B:
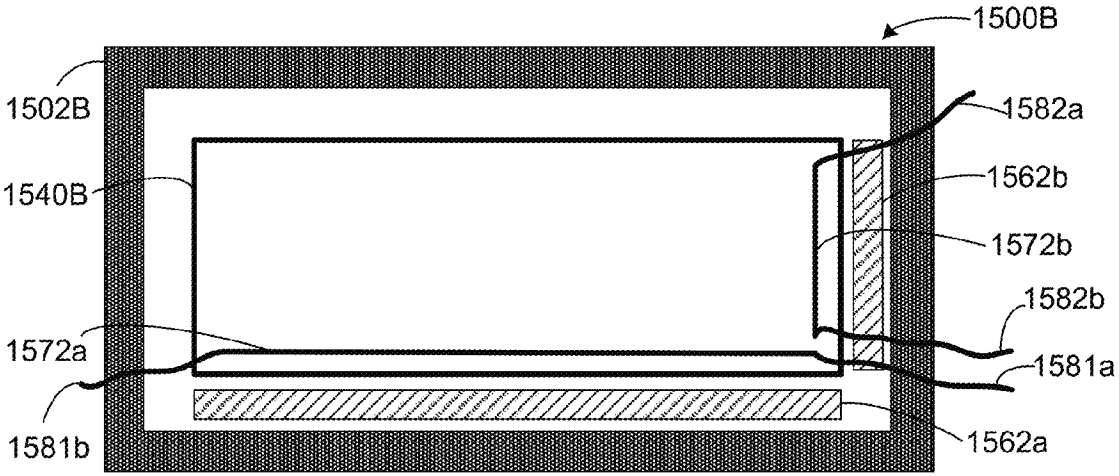
FIG. 7B is a top view of a partial cross-sectional drawing of another example driver in accordance with some of the acoustic transducer systems described herein.
Figure 7C:
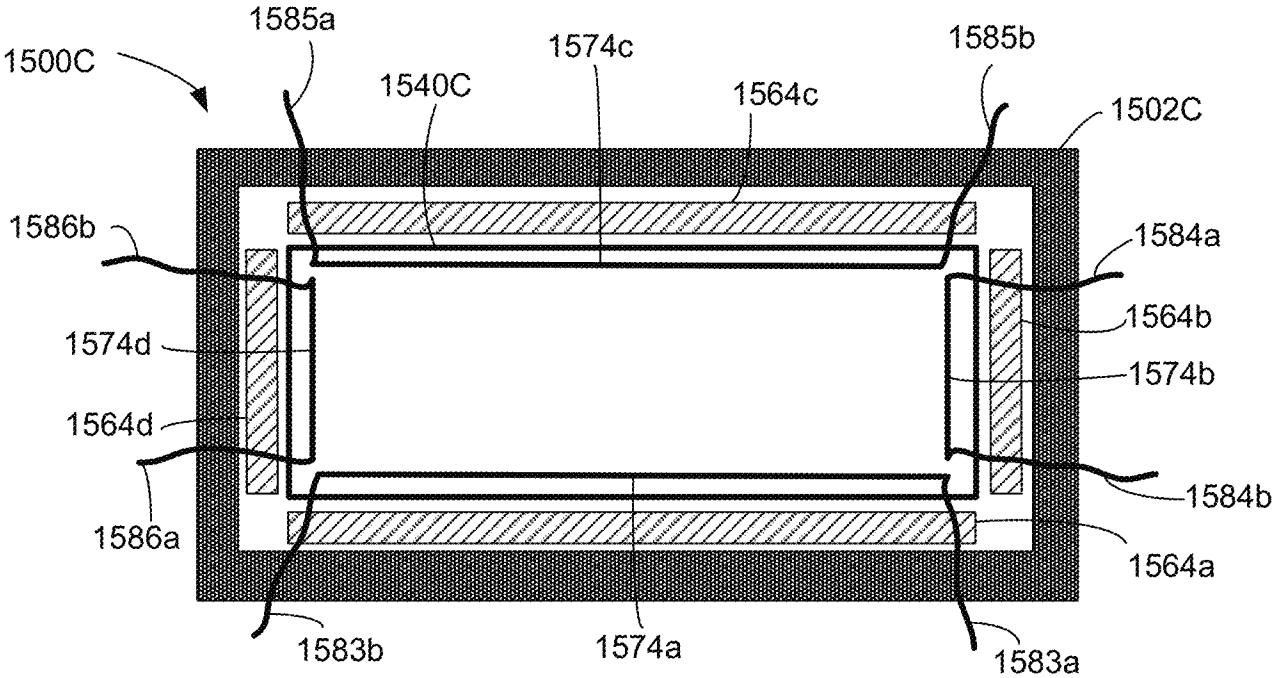
FIG. 7C is a top view of a partial cross-sectional drawing of another example driver in accordance with some of the acoustic transducer systems described herein.

FIGS. 7A to 7C illustrate top views of partial cross-sectional drawings of example drivers 1500A to 1500C, respectively. Unlike the drivers 1200A to 1200G, 1300A and 1300B shown in respective FIGS. 4A to 4G, 5A and 5B, the drivers 1500A to 1500C are characterized by a rectilinear geometry.

In FIG. 7A, the driver 1500A includes one tilt sensing component 1560 and a corresponding tilt coil segment 1570. The tilt coil segment 1570 is coupled to an interior surface of the former of the voice coil structure 1540A. In some other embodiments, the tilt coil segment 1570 can be coupled to an exterior of the former of the voice coil structure 1540A, or embedded or printed on either the interior or exterior of the former of the voice coil structure 1540A. The tilt coil segment 1570 has respective pairs of signal leads 1580*a* and 1580*b*. The tilt sensing component 1560 is positioned along the longitudinal end of the rectilinear-shaped driver 1500A. The controller 922 can determine a corrective force that the tilt coil segment 1570 needs to generate in order to adjust the alignment of the voice coil structure 1540A in a first axis of rotation, such as in the z-axis with reference to the coordinate system provided in FIG. 6A.

In FIG. 7B, the driver 1500B includes two tilt sensing components 1562*a* and 1562*b*, and two corresponding tilt coil segments 1572*a* and 1572*b*. The tilt coil segments 1572*a* and 1572*b* are coupled to an interior surface of the former of the voice coil structure 1540B. In some other embodiments, the tilt coil segments 1572*a* and 1572*b* can be coupled to an exterior surface of the former of the voice coil structure 1540B, or embedded or printed on either the interior or exterior of the former of the voice coil structure 1540B. Each of the tilt coil segments 1572*a* and 1572*b* has respective pairs of signal leads 1581*a* and 1581*b*, and 1582*a* and 1582*b*.

The tilt sensing components 1562*a* and 1562*b* are positioned generally orthogonal to each other at orthogonal sides of the driver 1500B. Using the tilt measurements detected by the tilt sensing components 1562*a* and 1562*b*, the controller 922 can determine a corrective force that each tilt coil segment 1572*a* and 1572*b* needs to generate in order to adjust the alignment of the voice coil structure 1540B. By positioning the tilt sensing components 1562*a* and 1562*b* orthogonal to each other, the tilt sensing module 910, or the controller 922, can determine the misalignment 1104' of the voice coil structure 1540B with greater sensitivity.

The driver 1500C in FIG. 7C includes four tilt sensing components 1564*a*, 1564*b*, 1564*c* and 1564*d*, and four corresponding tilt coil segments 1574*a*, 1574*b*, 1574*c*, and 1574*d*. The tilt coil segments 1574*a*, 1574*b*, 1574*c*, and 1574*d* are coupled to an interior surface of the former of the voice coil structure 1540C. In some other embodiments, the tilt coil segments 1574*a*, 1574*b*, 1574*c*, and 1574*d* can be coupled to an exterior of the former of the voice coil structure 1540B, or embedded or printed on either the interior or exterior of the former of the voice coil structure 1540B. Each of the tilt coil segments 1574*a*, 1574*b*, 1574*c*, and 1574*d* has respective pairs of signal leads 1583*a* and 1583*b*, 1584*a* and 1584*b*, 1585*a* and 1585*b*, and 1586*a* and 1586*b*.

Similar to drivers 1200E and 1200F, two pairs of tilt sensing components, namely 1564*a* and 1564*c*, and 1564*b* and 1564*d*, are positioned substantially opposite from each other. With the tilt measurements obtained by each pair of tilt sensing components 1564*a* and 1564*c*, and 1564*b* and 1564*d*, the controller 922 can determine the misalignment of the voice coil structure 1540C with greater accuracy and sensitivity. The corresponding correction signal applied to each of the tilt coil segments 1574*a*, 1574*b*, 1574*c*, and 1574*d* can also be more representative of the corrective force that needs to be generated by the respective tilt coil segments 1574*a*, 1574*b*, 1574*c*, and 1574*d* for minimizing the misalignment of the voice coil structure 1540C.

Similar to the drivers 1300A and 1300B shown in respective FIGS. 5A and 5B, the tilt of the voice coil structure 1440 can be determined using optical methods. The optical methods can involve comparing images obtained of an optical pattern, such as 1692A and 1692B, provided on a top surface of a diaphragm, such as diaphragms 1630A and 1630B of drivers 1600A and 1600B, respectively. An optical sensor, such as an image sensor, can also be mounted across from the top surface of the diaphragm 1630A, 1630B, such as on a bottom surface of a cover of the driver 1600A, 1600B.

Figure 8A:
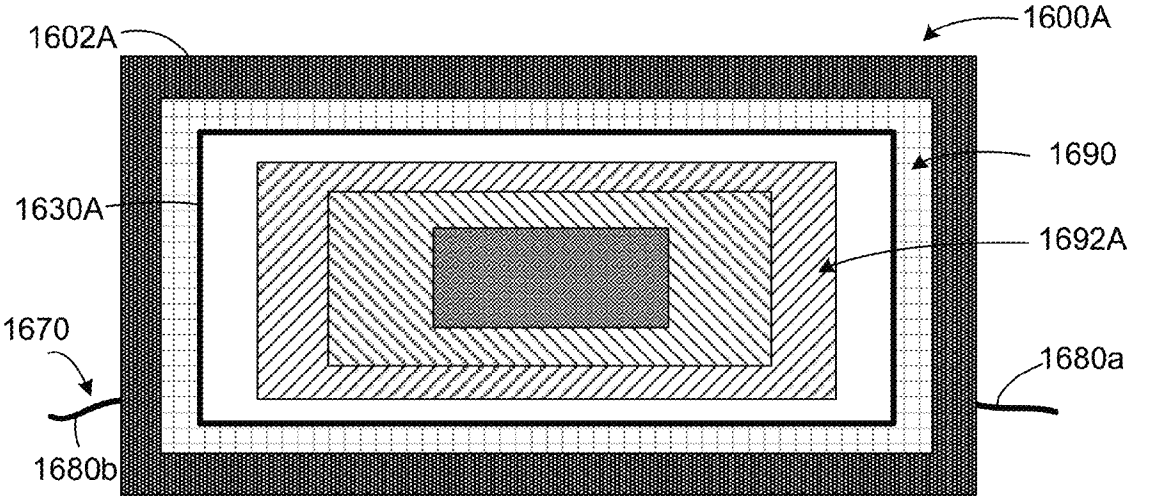
FIG. 8A is a top view of a partial cross-sectional drawing of an example driver in accordance with some of the acoustic transducer systems described herein.

FIG. 8A shows an optical pattern 1692A involving concentric rectangles on a top surface of the diaphragm 1630A. When the voice coil structure 1440 is tilted, the resulting image will show an offset version of the optical pattern 1692A. The tilt sensing module 910, or the controller 922, can then determine the misalignment of the voice coil structure 1440 by comparing the offset version of the optical pattern 1692A with the optical pattern 1692A at the initial alignment 1404 of the voice coil structure 1440.

Figure 8B:
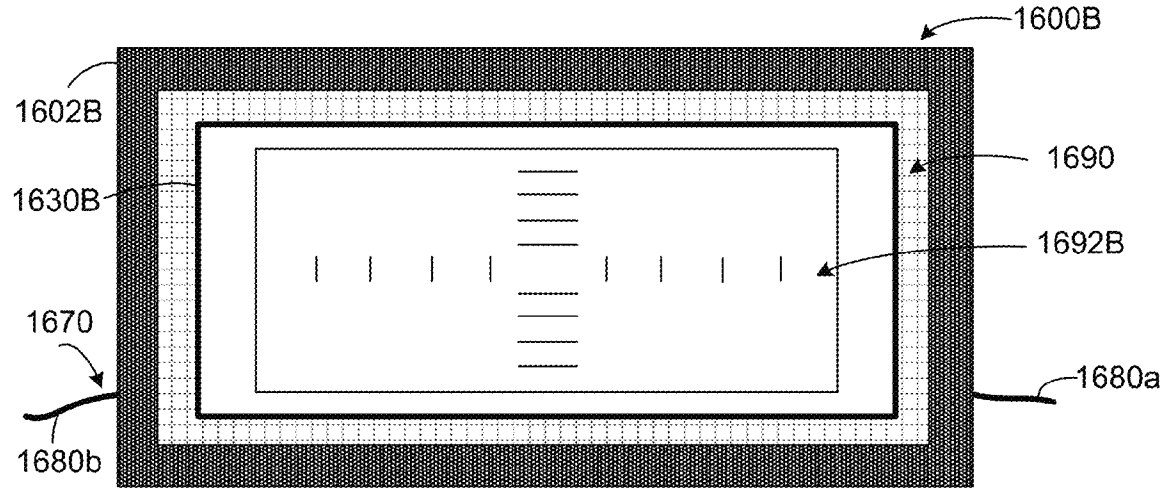
FIG. 8B is a top view of a partial cross-sectional drawing of another example driver in accordance with some of the acoustic transducer systems described herein.

FIG. 8B shows another optical pattern 1692B that can be provided on the diaphragm 1630B. The tilt sensing module 910, or the controller 922, can then determine the misalignment of the voice coil structure 1440 by comparing the offset version of the optical pattern 1692B with the optical pattern 1692B at the initial alignment 1404 of the voice coil structure 1440.

In some embodiments, the tilt sensing module 910 can include an optical sensor that can measure a tilt angle of the diaphragm 1630A and 1630B without referencing any optical patterns, such as optical patterns 1692A and 1692B.

FIG. 9 is a side view 1700 of a partial cross-sectional drawing of an example voice coil structure 1740. The voice coil structure 1740 shown in FIG. 9 is cylindrical in formation. In embodiments involving rectilinear drivers, such as driver 1400 shown in FIG. 6A, the corresponding voice coil structure 1740 can be rectilinear in formation.

The former 1740*f* of the voice coil structure 1740 has an exterior surface 1740*o* and an interior surface 1740*i*. As shown in FIG. 9, a tilt control coil 1770 can be provided at the exterior surface 1740*o* of the former 1740*f* and coupled with the voice coil 1740*c*. In this illustrated embodiment, the tilt control coil 1770 and the voice coil 1740*c* are layered on top of each other.

FIG. 10 is a front view 1800 of another example voice coil structure 1840. The voice coil structure 1840 shown in FIG. 10 is cylindrical in formation. In embodiments involving rectilinear drivers, such as driver 1400 shown in FIG. 6A, the corresponding voice coil structure 1840 can be rectilinear in formation.

The former 1840*f* of the voice coil structure 1840 has an exterior surface 1840*o* and an interior surface 1840*i*. Unlike the tilt control coil 1770 in FIG. 9, the tilt control coil 1870 in FIG. 10 is coupled to the interior surface 1840*i* of the former 1840*f* of the voice coil structure 1840 and the voice coil 1840*c* is coupled to the exterior surface 1840*o* of the former 1840*f*. The tilt control coil 1870 in this example embodiment includes three tilt coil segments, namely 1870*a*, 1870*b* and 1870*c*. Each of the tilt coil segments 1870*a*, 1870*b*, and 1870*c* has respective pairs of signal leads 1880*a* and 1880*b*, 1881*a* and 1881*b*, and 1882*a* and 1882*b*. Example coupling of the tilt control coil 1870 to the interior surface 1840*i* is shown in FIGS. 11A and 11B, and 12A and 12B.

Figure 11B:
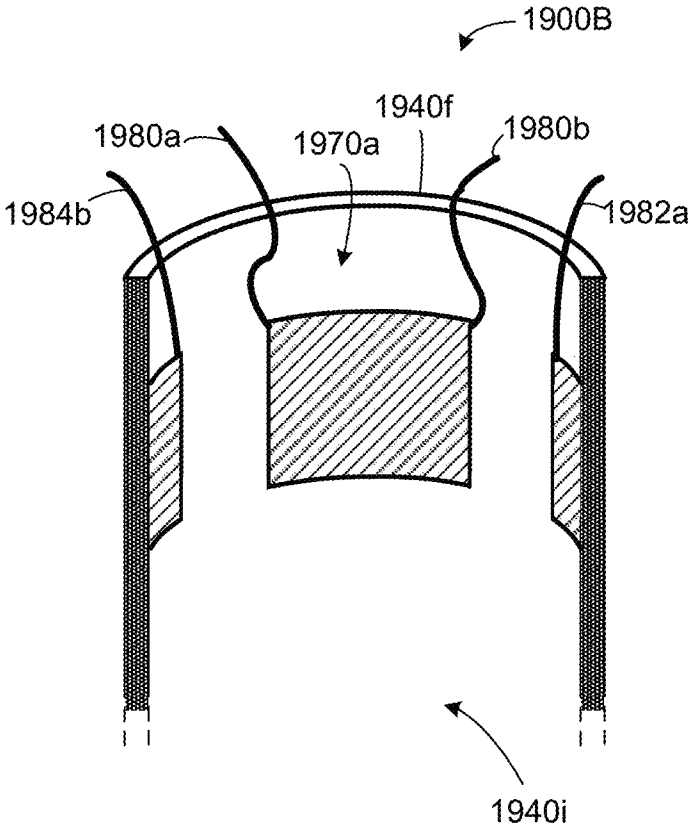
FIG. 11B is a cross-sectional drawing of the example voice coil structure shown in FIG. 11A.
Figure 11A:
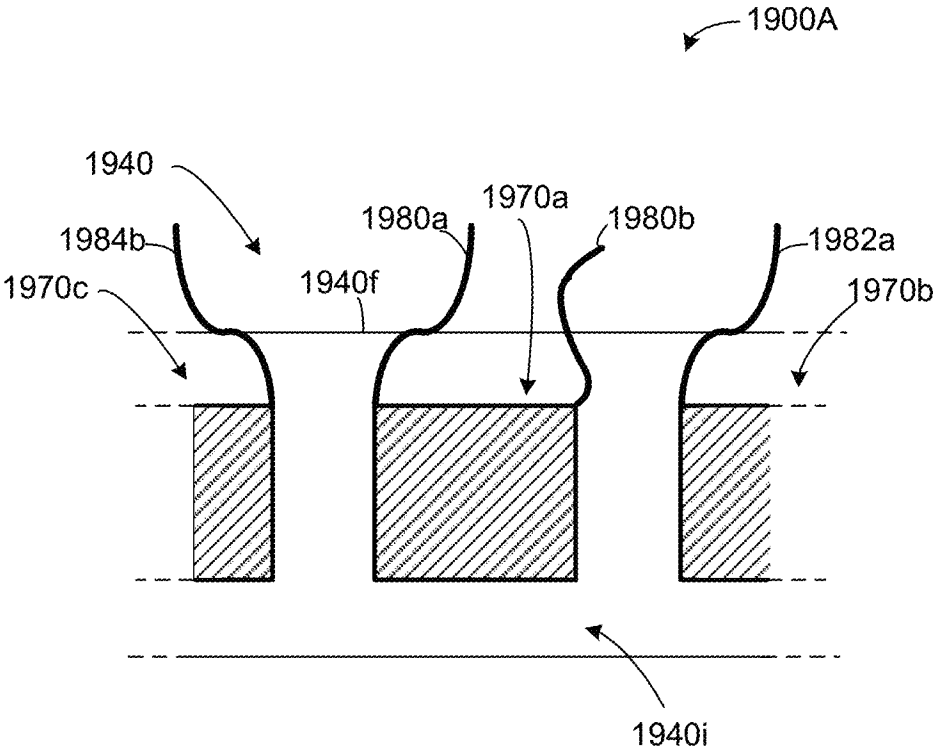
FIG. 11A is a partial drawing of an interior surface of an example voice coil structure in accordance with some of the acoustic transducer systems described herein.

FIG. 11A is a partial drawing 1900A of an interior surface 1940*i* of an example voice coil structure 1940 when the voice coil structure 1940 is unrolled. The voice coil structure 1940 of FIG. 11A can be formed into a cylindrical structure for use in some of the drivers described herein. FIG. 11B shows an example cross-sectional view 1900B of the voice coil structure 1940 when formed into the cylindrical structure.

The tilt control coil 1970 includes three tilt coil segments 1970*a* to 1970*c*. Each of the tilt coil segments 1970*a* to 1970*c* can be a conductive layer provided at the interior surface 1940*i*. Each of the tilt coil segments 1970*a* to 1970*c* has a respective pair of signal leads. Tilt coil segment 1970*a* has signal leads 1980*a* and 1980*b*, tilt coil segment 1970*b* has signal leads 1982*a* and another lead not shown in FIGS. 11A and 11B, and tilt coil segment 1970*c* has signal leads 1984*a* and another lead not shown in FIGS. 11A and 11B.

The tilt coil segments 1970*a* to 1970*c* may be formed onto the interior surface 1940*i* using vapour deposition, printing and/or adhesion. A height of the tilt coil segments 1970*a* to 1970*c* can extend along the axial length of the voice coil structure 1940 in order to maximize interaction with the magnetic field strength (B) within and near the air gap 1134. In some embodiments, the height of the tilt coil segments 1970*a* to 1970*c* can be substantially similar to a height of the air gap 1134.

By providing the tilt coil segments 1970*a* to 1970*c* shown in FIG. 11A as a conductive layer with a rectangular cross section, the electrical conductivity can be increased while reducing the associated $I^2R$ losses. The rectangular cross section also maximizes the interaction with the magnetic field strength (B) within the air gap 1134 and within the vicinity of the air gap 1134.

In some embodiments, a position of the tilt coil segments 1970*a* to 1970*c* on the former 1940*f* of the voice coil structure 1940 can be designed to maximize the interaction with the magnetic field strength (B) within the air gap 1134.

By positioning the tilt coil segments 1970*a* to 1970*c* to maximize the interaction with the magnetic field strength (B), the corresponding corrective force generated by the tilt coil segments 1970*a* to 1970*c* can also be maximized at axial displacements of the voice coil structure 1940 at which the required corresponding corrective forces are greatest.

Figure 12B:
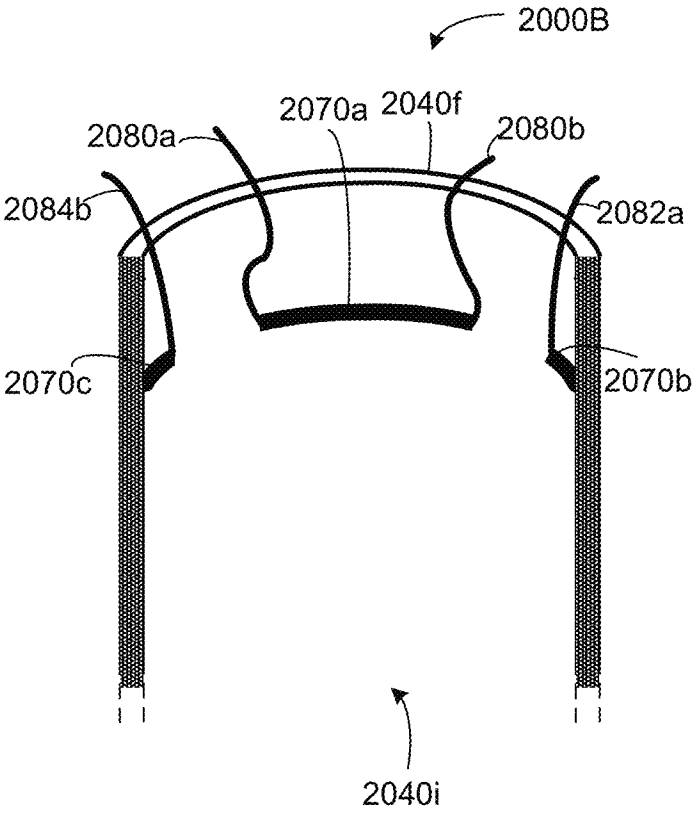
FIG. 12B is a cross-sectional drawing of the example voice coil structure shown in FIG. 12A.
Figure 12A:
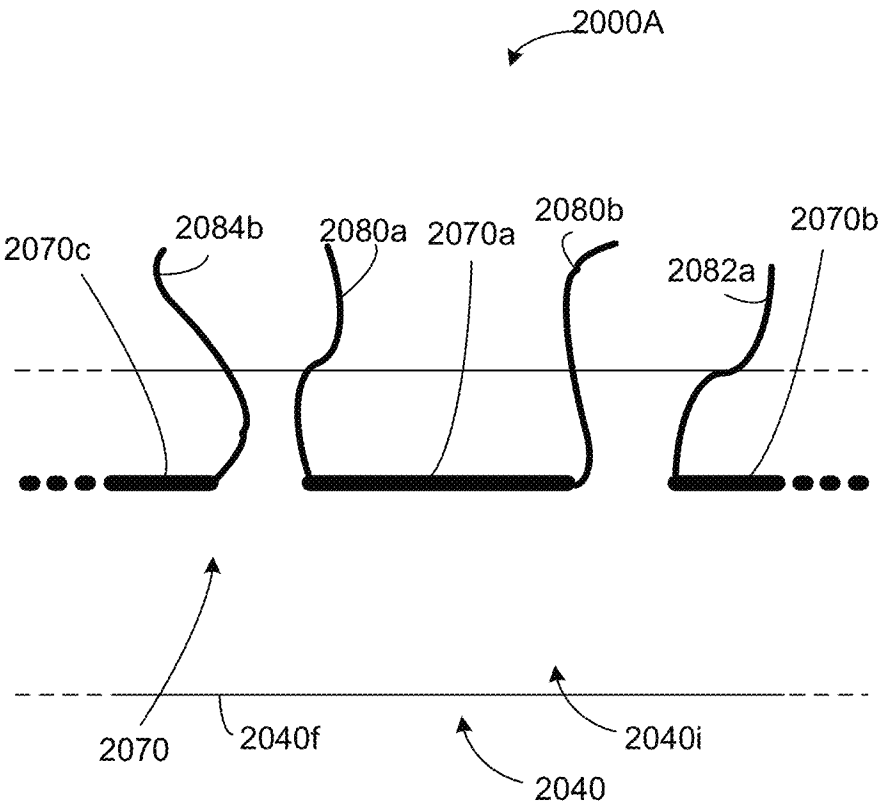
FIG. 12A is a partial drawing of an interior surface of another example voice coil structure in accordance with some of the acoustic transducer systems described herein.

FIG. 12A is a partial drawing 2000A of an interior surface 2040*i* of a former 2040*f* of another example voice coil structure 2040 when the voice coil structure 2040 is unrolled. The voice coil structure 2040 of FIG. 12A can be formed into a cylindrical structure for use in at least some of the drivers described herein. FIG. 12B shows an example cross-sectional view 2000B of the voice coil structure 2040 when formed into the cylindrical structure.

The tilt control coil 2070 includes three tilt coil segments 2070*a* to 2070*c*, and can be a conductive wire coupled to the interior surface 2040*i*. Each of the tilt coil segments 2070*a* to 2070*c* has a respective pair of signal leads. Tilt coil segment 2070*a* has signal leads 2080*a* and 2080*b*, tilt coil segment 2070*b* has signal leads 2082*a* and another lead not shown in FIGS. 12A and 12B, and tilt coil segment 2070*c* has signal leads 2084*a* and another lead not shown in FIGS. 12A and 12B.

In some embodiments, the controller 922 can selectively operate in two different modes in response to a mode selection input.

During a first mode of operation, the controller 922 can operate to transmit the input audio signal to the voice coil 1140*c*, 1440*c* and to transmit the correction signal to the tilt control coil 1170, 1470 in response to the detected misalignment 1104', 1404' in accordance with the embodiments described herein.

During a second mode of operation, the controller 922 can operate to transmit the input audio signal to both the voice coil 1140*c*, 1440*c* and the tilt control coil 1170, 1470. In effect, the tilt control coil 1170, 1470 can act as a secondary voice coil. The second mode of operation can be used when a high excursion of the voice coil 1140*c*, 1440*c* is desired. By applying the input audio signal also to the tilt control coil 1170, 1470, an additive force is applied to the voice coil structure 1140, 1440 so that the voice coil structure 1140, 1440 moves in response to the force generated by the voice coil 1140*c*, 1440*c* and the tilt control coil 1170, 1470. The input audio signal can be applied to the tilt control coil 1170, 1470 during the peaks of the excursion of the voice coil structure 1140, 1440. The tilt control coil 1170, 1470 in these embodiments has at least a full turn radially around a circumference of the voice coil structure 1140, 1440.

In some embodiments, the input audio signal applied to the tilt control coil 1170, 1470 can be combined with the correction signal to also address the detected misalignment 1104', 1404'.

Various embodiments have been described herein by way of example only. Various modification and variations may be made to these example embodiments without departing from the spirit and scope of the invention, which is limited only by the appended claims.

I claim:

1. An acoustic transducer system comprising:

a driver motor operable to generate a magnetic flux;

a diaphragm operably coupled to the driver motor;

a voice coil structure coupled to the diaphragm, the voice coil structure being movable at least in response to the magnetic flux, and the voice coil structure comprising:

a former;

a voice coil coupled to the former and the voice coil movable at least in response to an input audio signal; and a tilt control coil coupled to the former;

a tilt sensing module coupled to the voice coil structure, the tilt sensing module detecting a misalignment of the voice coil structure relative to an initial alignment of the voice coil structure; and a controller coupled to the driver motor and the tilt sensing module, the controller being operable to:

transmit the input audio signal to the voice coil;

generate a correction signal based at least on the misalignment detected by the tilt sensing module; and transmit the correction signal to the tilt control coil, the correction signal causing the tilt control coil to generate a corrective force for minimizing the misalignment of the voice coil structure.

2. The acoustic transducer system of claim 1, wherein:

the tilt sensing module comprises a first tilt sensing component, the first tilt sensing component operating to detect the misalignment of the voice coil structure at a first section of the voice coil structure; and the tilt control coil comprises a first tilt coil segment for generating a corrective force in response to the correction signal, the corrective force minimizing the misalignment of the voice coil structure in a first axis of rotation.

3. The acoustic transducer system of claim 2, wherein:

the tilt sensing module further comprises:

a second tilt sensing component operating to detect the misalignment of the voice coil structure at a second section of the voice coil structure, the first section being different from the second section;

the controller being operable to generate the correction signal based on the misalignment detected by the first and second tilt sensing components at the respective first and second sections of the voice coil structure; and the first tilt coil segment generating the corrective force in response to the correction signal for minimizing the misalignment of the voice coil structure in at least one of the first axis of rotation and a second axis of rotation, the second axis of rotation being orthogonal to the first axis of rotation.

4. The acoustic transducer system of claim 3, wherein:

the tilt control coil further comprises a second tilt coil segment, each of the first tilt coil segment and the second tilt coil segment generating a respective corrective force in response to the correction signal, and the respective corrective force minimizing the misalignment of the voice coil structure in at least one of the first axis and the second axis.

5. The acoustic transducer system of claim 4, wherein the corrective force generated by the first tilt coil segment is different from the corrective force generated by the second tilt coil segment.

6. The acoustic transducer system of claim 3, wherein:

the tilt sensing module further comprises:

a third tilt sensing component operating to detect the misalignment of the voice coil structure at a third section of the voice coil structure, the third section being different from the first section and the second section;

the controller being operable to generate the correction signal based on the misalignment detected by the first, the second and the third tilt sensing components at the respective first, second and third sections of the voice coil structure; and the first tilt coil segment generating the corrective force in response to the correction signal for minimizing the misalignment of the voice coil structure in the first axis of rotation, the second axis of rotation, and a third axis of rotation orthogonal to the first and the second axes of rotation.

7. The acoustic transducer system of claim 6, wherein:

the tilt control coil further comprises a second tilt coil segment, each of the first tilt coil segment and the second tilt coil segment generating a respective corrective force in response to the correction signal, and the respective corrective force minimizing the misalignment of the voice coil structure in at least one of the first axis, the second axis, and the third axis.

8. The acoustic transducer system of claim 7, wherein:

the tilt control coil further comprises a third tilt coil segment, each of the first, second and third tilt coil segments generating a respective corrective force in response to the correction signal, and the respective corrective force minimizing the misalignment of the voice coil structure in at least one of the first axis, the second axis, and the third axis.

9. The acoustic transducer system of claim 1, wherein the tilt control coil is mounted radially along a circumference of the former of the voice coil structure.

10. The acoustic transducer system of claim 9, wherein the tilt control coil comprises two or more tilt coil segments, the two or more tilt coil segments being mounted substantially equidistant along the circumference of the former of the voice coil structure.

11. The acoustic transducer system of claim 1, wherein the tilt sensing module comprises a pair of tilt sensing components, and one tilt sensing component of the pair of tilt sensing components being positioned substantially opposite from the other tilt sensing component of the pair of tilt sensing components.

12. The acoustic transducer system of claim 1, wherein the tilt sensing module comprises a pair of tilt sensing components, and one tilt sensing component of the pair of tilt sensing components being positioned substantially orthogonal to the other tilt sensing component of the pair of tilt sensing components.

13. The acoustic transducer system of claim 1, wherein the tilt control coil is formed at an exterior surface of the former of the voice coil structure.

14. The acoustic transducer system of claim 13, wherein the tilt control coil is coupled to the voice coil.

15. The acoustic transducer system of claim 1, wherein the tilt control coil is formed at an interior surface of the former of the voice coil structure.

16. The acoustic transducer system of claim 1, wherein the tilt control coil is selected from the group consisting of a conductive layer and a conductive wire.

17. The acoustic transducer system of claim 1, wherein:

an optical pattern is provided at a top surface of the diaphragm; and the tilt sensing module comprises an optical sensor for capturing images of the optical pattern during operation of the driver motor, and the tilt sensing module operating to compare one or more images of the optical pattern with the optical pattern at the initial alignment for detecting the misalignment.

18. A method for operating an acoustic transducer, the method comprising:

operating a driver motor to generate a magnetic flux;

receiving an input audio signal and transmitting the input audio signal to a voice coil, the voice coil being movable at least in response to the magnetic flux and the input audio signal, and the voice coil being provided at a voice coil structure coupled to a diaphragm;

detecting, by a tilt sensing module, a misalignment of the voice coil structure relative to an initial alignment of the voice coil structure;

generating, by a controller coupled to the driver motor and the tilt sensing module, a correction signal based at least on the misalignment detected by the tilt sensing module; and transmitting the correction signal to one of (i) a tilt control coil coupled to the voice coil structure and (ii) the voice coil, the correction signal causing the tilt control coil or the voice coil to generate a corrective force for minimizing the misalignment of the voice coil structure.

19. The method of claim 18, wherein generating the correction signal comprises:

receiving a misalignment signal from the tilt sensing module, the misalignment signal representing the misalignment of the voice coil structure relative to the initial alignment of the voice coil structure;

determining the misalignment with respect to the initial alignment of the voice coil structure from the misalignment signal; and determining the corrective force to be generated by the tilt control coil or the voice coil for minimizing the misalignment of the voice coil structure.

20. The method of claim 19, wherein generating the correction signal further comprises:

in response to receiving the misalignment signal, determining whether the misalignment exceeds a misalignment tolerance range; and in response to determining the misalignment exceeds the misalignment tolerance range, determining the corrective force to be generated by the tilt control coil or the voice coil for minimizing the misalignment of the voice coil structure, otherwise, generating a null signal for causing no movement of the voice coil structure by the tilt control coil or the voice coil.

21. The method of claim 18 further comprises:

detecting the misalignment at a first section of the voice coil structure; and determining a corrective force for minimizing the misalignment of the voice coil structure in a first axis of rotation.

22. The method of claim 21 further comprises:

detecting the misalignment at a second section of the voice coil structure, the first section being different from the second section; and determining the corrective force for minimizing the misalignment of the voice coil structure in at least one of the first axis and a second axis orthogonal to the first axis.

23. The method of claim 18 further comprises:

receiving, at the controller, a mode selection input for selectively operating the acoustic transducer in a first mode and a second mode different from the first mode;

in response to receiving the mode selection input corresponding to the first mode, the controller operates to: transmit the input audio signal to the voice coil; and generate the correction signal in response to the detected misalignment of the voice coil structure and transmit the correction signal to the tilt control coil; and in response to receiving the mode selection input corresponding to the second mode, the controller operates to:

transmit the input audio signal to the voice coil and the tilt control coil.

* * * * *